US009901127B2

(12) United States Patent
LeMarbe

(10) Patent No.: US 9,901,127 B2
(45) Date of Patent: Feb. 27, 2018

(54) QUICK RELEASE FASTENING SYSTEM

(71) Applicant: Point Blank Enterprises, Inc., Pompano Beach, FL (US)

(72) Inventor: Randall Jered LeMarbe, Coral Springs, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 0 days.

(21) Appl. No.: 14/609,049

(22) Filed: Jan. 29, 2015

(65) Prior Publication Data

US 2016/0015096 A1 Jan. 21, 2016

Related U.S. Application Data

(60) Provisional application No. 62/024,640, filed on Jul. 15, 2014.

(51) Int. Cl.
*A41D 13/05* (2006.01)
*A41F 1/04* (2006.01)

(52) U.S. Cl.
CPC ..... *A41D 13/0562* (2013.01); *A41D 13/05* (2013.01); *A41D 13/0556* (2013.01); *A41D 13/0568* (2013.01)

(58) Field of Classification Search
CPC .... A41F 1/00; A41F 9/00; A41F 9/002; F41H 1/02; A41D 13/0518; A41D 13/0562; A41D 1/04; A41D 2300/32; A41D 2300/33; Y10T 24/1397; Y10T 247/27; Y10T 24/2708; Y10T 24/39; Y10T 24/3982; Y10T 24/3991
USPC .... 2/102, 463, 465, 2.5, 309, 310, 311, 319, 2/322
See application file for complete search history.

(56) References Cited

U.S. PATENT DOCUMENTS 4,497,069 A * 2/1985 Braunhut ..... F41H 1/02 2/2.5
5,373,582 A * 12/1994 Dragone ..... F41H 1/02 2/102
5,586,969 A * 12/1996 Yewer, Jr. ..... A61F 5/028 128/101.1
5,690,609 A * 11/1997 Heinze, III ..... A61F 5/028 128/115.1
5,785,011 A * 7/1998 Gitterman, III ..... B68B 1/02 119/865
6,137,675 A * 10/2000 Perkins ..... G06F 1/163 128/876
6,419,652 B1 * 7/2002 Slautterback ..... A61F 5/028 128/96.1

(Continued)

*Primary Examiner* — Jameson Collier
*Assistant Examiner* — Heather Mangine
(74) *Attorney, Agent, or Firm* — Honigman Miller Schwartz and Cohn LLP

(57) ABSTRACT

A quick release fastening system associated with wearable articles is disclosed. The quick release fastening system includes a hook and loop fastener and a pull cord. A quick release of the fastening system can be accomplished with a frontal pull of the pull cord, which disengages the hook and loop fastener. No hardware is necessary to fasten or release the system. In some forms of the invention, the pull cord partially resides within a conduit that can be attached to or formed through the wearable article. The quick release fastening system is useful in any application wherein two articles need to be releasably fastened, including tactical vest applications of various types.

25 Claims, 30 Drawing Sheets

(56) References Cited

U.S. PATENT DOCUMENTS

| | | | | |
|---|---|---|---|---|
| 6,434,802 | B1 * | 8/2002 | Pannone | A41F 1/02 2/128 |
| 6,755,799 | B2 * | 6/2004 | Toda | A61F 5/028 2/311 |
| 6,769,137 | B2 * | 8/2004 | D'Annunzio | F41H 1/02 2/102 |
| 6,820,280 | B1 * | 11/2004 | Atallah | A41D 1/04 2/102 |
| 7,047,570 | B2 * | 5/2006 | Johnson | F41H 1/02 2/102 |
| 7,103,921 | B1 * | 9/2006 | Shoemaker | A41F 9/00 2/312 |
| 7,473,235 | B2 * | 1/2009 | Schwenn | A61F 5/0193 128/100.1 |
| 7,536,728 | B1 * | 5/2009 | Leathers | F41H 1/02 2/2.5 |
| 7,900,278 | B2 * | 3/2011 | Pittman | A45F 3/14 2/310 |
| 8,490,212 | B1 * | 7/2013 | Asher | A41D 1/04 2/2.5 |
| 2011/0088225 | A1 * | 4/2011 | Fernandez | A44B 18/0069 24/450 |
| 2013/0298318 | A1 * | 11/2013 | Rogers | A42B 3/185 2/439 |
| 2015/0153140 | A1 * | 6/2015 | Crye | F41H 1/02 2/102 |
| 2015/0237925 | A1 * | 8/2015 | Sewell | A41D 13/0015 2/455 |

* cited by examiner

QUICK RELEASE FASTENING SYSTEM

CROSS REFERENCE TO RELATED APPLICATIONS

This U.S. patent application claims priority under 35 U.S.C. § 119(e) to U.S. Provisional Application 62/024,640, filed on Jul. 15, 2014. The disclosures of this prior application are considered part of the disclosure of this application and are hereby incorporated by reference in their entireties.

TECHNICAL FIELD

This disclosure relates to quick release fastening systems for fastening and releasing connections associated with gear or apparel, such as cummerbunds and tactical vests.

BACKGROUND

There is some gear or apparel that requires one or more secure fastening systems. In some situations, it is advantageous to quickly release such fastening systems.

In the tactical vest industry, there is a long-felt need for a quick release fastening system. It is advantageous for tactical vests to be equipped with a cummerbund to provide additional protective plating or to allow for the carrying of ballistics. However, emergency situations can arise when a user is wearing a tactical vest and cummerbund. Such situations often require quick removal of the cummerbund or quick removal of the full tactical vest. In the tactical vest industry, removal of the cummerbund is generally accomplished by utilizing a cable release system to disengage the fastener. Such cable release systems are complicated and can lead to problems in these emergency situations. Therefore, a need exists in the art to develop a quick release fastening system that can be accomplished simply, using no hardware.

SUMMARY

The present disclosure provides a quick release fastening system.

One aspect of the disclosure provides a quick release fastening system for fastening and releasing a wearable article, such as a vest or a cummerbund. The system may include a cummerbund and a pull cord. The cummerbund has a first end terminating into a connector. The connector includes at least one of a hook portion or a loop portion of a hook and loop fastener. The pull cord has opposing first and second ends. The first end of the pull cord is fastened to the connector.

Implementations of the disclosure may include one or more of the following features. In some implementations, the wearable article is associated with a vest. The vest may include a front portion and a back portion. Additionally, the connector may reside proximate the back portion of the vest. The second end of the pull cord may extend to reside proximate the front portion of the vest.

In some other implementations of the disclosure, the pull cord may extend laterally along a portion of the wearable article. Additionally, the pull cord may partially reside in a conduit. The conduit may extend laterally along a portion of the wearable article. The second end of the pull cord may extend outside of the conduit.

In some examples, the conduit may be attached to the wearable article. In other examples, the conduit may be formed at least partially through the wearable article. Further, the wearable article may be connected to the vest.

Another aspect of the disclosure provides a quick release fastening system for fastening and releasing a cummerbund associated with a vest. This system includes a cummerbund, a vest, and a pull cord. The cummerbund has a first end that terminates into a first connector. The first connector includes at least one of a hook portion or a loop portion of a hook and loop fastener. The vest has a front portion and a back portion. The pull cord has opposing first and second ends. The first end of the pull cord attaches to a second connector. The second end of the pull cord resides proximate the back portion of the vest. The second connector resides proximate the back portion of the vest and includes at least one of a hook portion or a loop portion of a hook and loop fastener.

Implementations of the disclosure may include one or more of the following features. In some implementations, the pull cord may extend vertically upwards from the first end of the pull cord. The pull cord may partially reside in a conduit.

In some examples, the conduit may be attached to at least one of the front portion of the vest or the back portion of the vest. Additionally, the conduit may be attached to both the front portion of the vest and the back portion of the vest. In other examples, the conduit may be formed at least partially through at least one of the front portion of the vest or the back portion of the vest. Further, the conduit may be formed at least partially through both the front portion of the vest and the back portion of the vest.

In some implementations, a second end of the cummerbund may terminate into a third connector. The third connector may include at least one of a hook portion or a loop portion of a hook and loop fastener. The second connector fastens to both the first connector and the third connector.

Additionally, the pull cord may attach to a fourth connector at a non-end point of the pull cord. The fourth connector may include at least one of a hook portion or a loop portion of a hook and loop fastener. The fourth connector may also fasten the back portion of the vest to a shoulder strap attached to the front portion of the vest. Alternatively, the fourth connector may fasten the front portion of the vest to a shoulder strap attached to the back portion of the vest.

Yet another aspect of the disclosure provides a quick release fastening system for fastening a front portion of a vest to a back portion of a vest at a shoulder strap. This system includes a shoulder strap, a connector, and a pull cord. The shoulder strap is associated with a vest. The shoulder strap has opposing first and second ends. The first end of the shoulder strap attaches either to a front portion of the vest or to a back portion of the vest. The connector attaches to the second end of the shoulder strap. The connector includes at least one of a hook portion or a loop portion of a hook and loop fastener. The pull cord has opposing first and second ends. The first end of the pull cord attaches to the connector. The second end of the pull cord resides proximate the front portion of the vest.

Implementations of the disclosure may include one or more of the following features. In some implementations, the connector may fasten to an opposing connector. The opposing connector may be attached to the back portion of the vest. The pull cord may partially reside in a conduit. The second end of the pull cord may extend outside of the conduit.

In some examples, the conduit may be attached to at least one of the front portion of the vest, the back portion of the vest, or the shoulder strap. In other examples, the conduit may be formed at least partially through at least one of the front portion of the vest, the back portion of the vest, or the shoulder strap.

In other implementations of the disclosure, the connector may fasten to an opposing connector. The opposing connector may be attached to the front portion of the vest. The pull cord may partially reside in a conduit. The second end of the pull cord may extend outside of the conduit.

In some examples, the conduit may be attached to the front portion of the vest. In other examples, the conduit may be formed at least partially through the front portion of the vest.

Another aspect of the disclosure provides a method of releasing a fastening system. The method includes pulling a second end of a pull cord. The second end of the pull cord resides proximate a front portion of a vest. The pull cord has a first end opposing the second end. The first end of the pull cord attaches to a connector. The connector has at least one of a hook portion or a loop portion of a hook and loop fastener. The method also includes peeling the connector from an opposing connector to disengage the hook and loop fastener. When fastened, the connector and opposing connector reside proximate a back portion of the vest.

In some examples, the method may further comprise releasing a connection that fastens two ends of a cummerbund. The method may further comprise, simultaneous to releasing the connection that fastens the two ends of a cummerbund, releasing an additional connection that fastens a shoulder strap to the vest. In other examples, the method may further comprise releasing a connection that fastens a shoulder strap to the vest.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 4 shows the portion of the cummerbund that fastens to the first portion of the cummerbund shown in FIG. 2.

FIG. 11A shows the cummerbund before the user has engaged the frontal pull of the quick release fastening system.

FIG. 11B shows the cummerbund as the user has begun to engage the frontal pull of the quick release fastening system.

FIG. 11C shows the cummerbund as the user continues to engage the frontal pull of the quick release fastening system.

FIG. 11D shows the cummerbund after the user has completed engagement of the frontal pull of the quick release fastening system.

FIG. 13A shows the vest and cummerbund as the user has begun to engage the frontal pull of the quick release fastening system.

FIG. 13B shows the vest and cummerbund after the user has completed engagement of the frontal pull of the quick release fastening system.

FIG. 13C shows the vest and cummerbund after the user has completed engagement of the frontal pull of the quick release fastening system.

FIG. 15A shows an exemplary implementation of the quick release fastening system, in which a single pull cord is utilized for release of two fastening systems.

FIG. 15B shows an exemplary implementation of the quick release fastening system, in which a single pull cord is utilized for release of two fastening systems.

FIG. 15D shows the vest and cummerbund after the user has completed engagement of the frontal pull of the quick release fastening system.

FIG. 15E shows the vest and cummerbund after the user has completed engagement of the frontal pull of the quick release fastening system.

FIG. 16B shows the vest and cummerbund after the user has completed engagement of the front pull of the quick release fastening system.

Like reference symbols in the various drawings indicate like elements.

DETAILED DESCRIPTION

Exemplary embodiments of the invention are shown in FIGS. 1A, 1B, 9, 12A, 12B, 12C, 14A, 14B, 15A, 15B, 15C, and 16A. In these embodiments, the quick release fastening system is utilized to fasten and release two wearable articles, such as a cummerbund 2 associated with a vest 1. The vest 1 has a front portion 1*a* and a back portion 1*b*. The front portion 1*a* of the vest 1 can be, but need not be, attached to the back portion 1*b* of the vest 1.

The pull cord 3 has an opposing first end 3*a* (e.g., a peelable end) and second end 3*b* (e.g., a handle end). The second end 3*b* of the pull cord 3 is positioned at the front portion 1*a* of the vest 1. This positioning allows the user to engage the quick release mechanism of the fastening stem with a frontal pull of the second end 3*b* of the pull cord 3.

The pull cord 3 extends from its second end 3*b* at the front portion 1*a* of the vest 1 to its first end 3*a*. In the exemplary embodiments, the pull cord 3 partially resides within a conduit 4, in order to maintain the positioning of the pull cord 3, its first end 3*a*, and its second end 3*b*. The conduit 4 may continuously extend from front portion 1*a* of the vest 1 to the back portion 1*b* of the vest 1. The conduit 4 may also consist of one or more straps. The invention can also be accomplished by maintaining the positioning of the pull cord 3 with other means, not requiring a conduit 4.

The conduit 4 is formed through the cummerbund 2. However, the quick release fastening system can also be accomplished with a conduit 4 that is attached to the cummerbund 2, utilizing any one of a variety of attachment means.

Figure 1A:
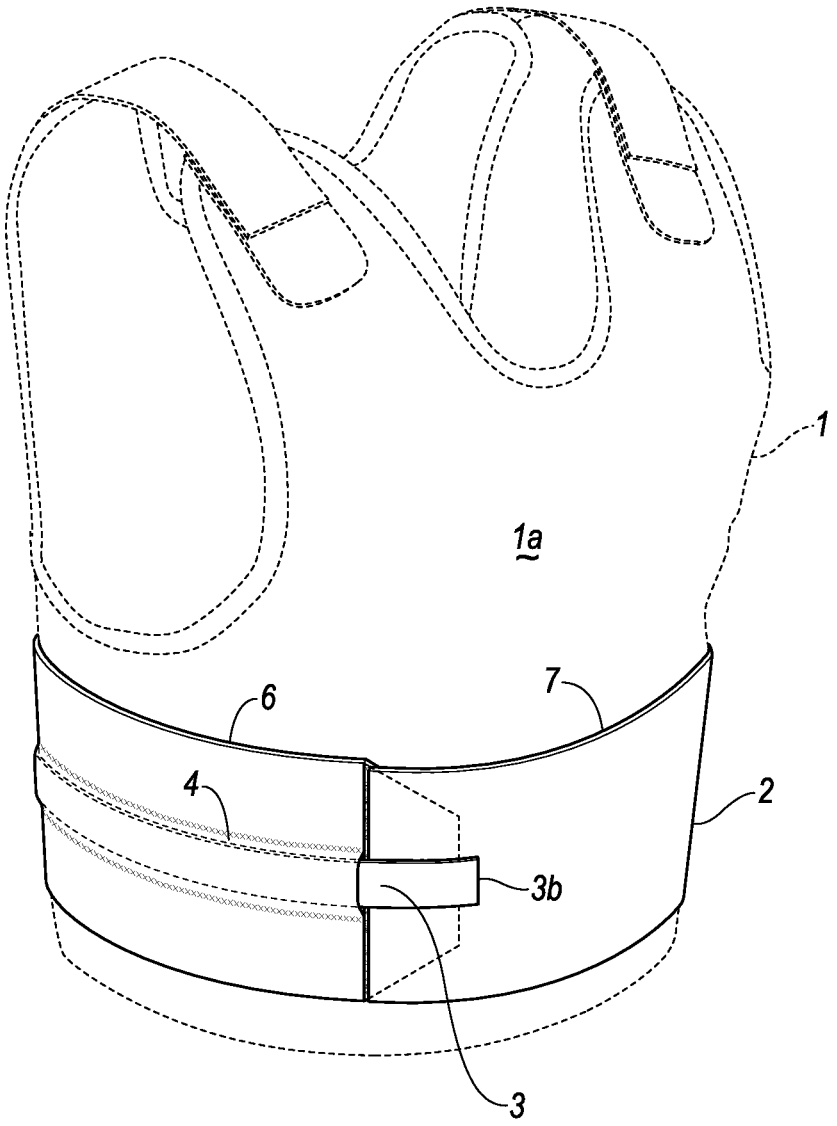
FIG. 1A is an isometric view of the front portion of a wearable article such as a vest including a cummerbund that utilizes an exemplary implementation of the quick release fastening system.
Figure 1B:
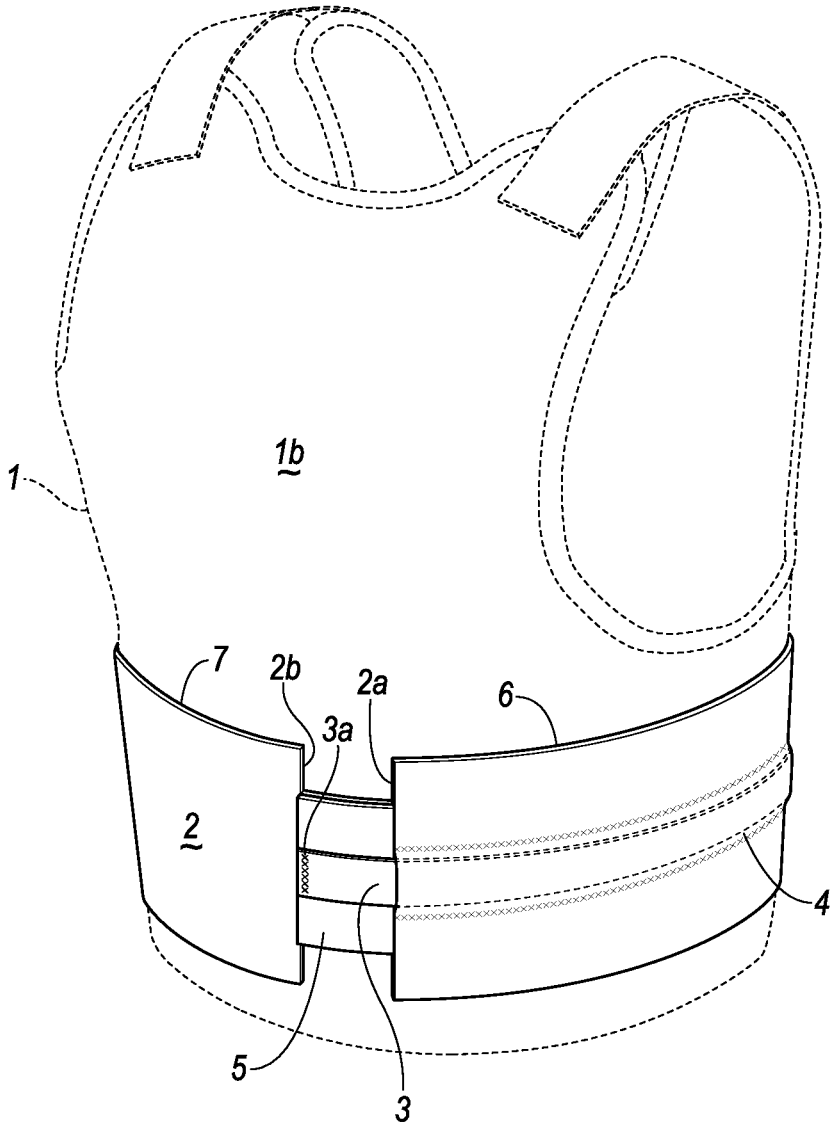
FIG. 1B is an isometric view of the back portion of a wearable article including a cummerbund that utilizes an exemplary implementation of the quick release fastening system.

Referring to FIGS. 1A and 1B, in some implementations, the cummerbund 2 is comprised of a first half 6 and a second half 7. The quick release fastening system utilizes a connector 5 to fastens the first half 6 of the cummerbund 2 to the second half 7 of the cummerbund 2 at the back portion 1*b* of the vest 1.

The first end 3*a* of the pull cord 3 is attached to the connector 5 at the back portion 1*b* of the vest 1.

The second end 3*b* of the pull cord 3 resides proximate to the front portion 1*a* of the vest 1. With a frontal pull of the second end 3*b* of the pull cord 3, the user is able to engage the quick release function of the fastening system. A user's engagement of the quick release function causes the first end 3*a* of the pull cord 3 to peel the connector 5 at the back portion 1*b* of the vest 1 to disengage the hook and loop fastener.

Figure 1C:
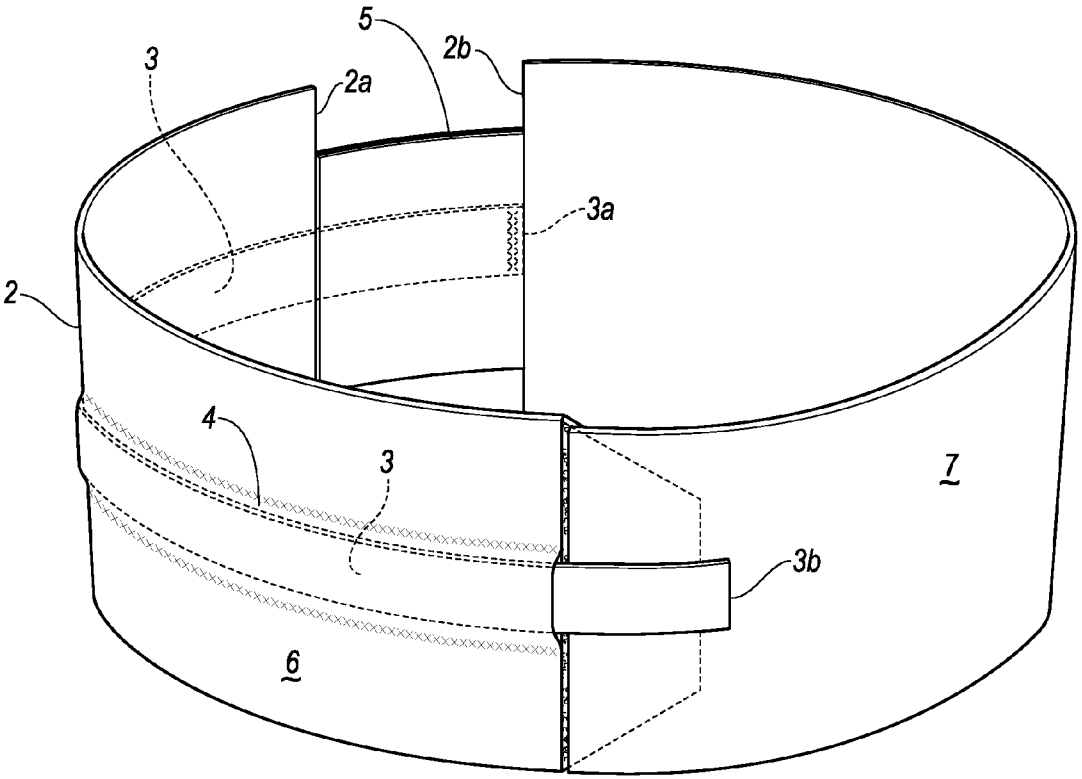
FIG. 1C is an isometric view of the cummerbund of FIGS. 1A and 1B.

Referring to FIG. 1C, in some implementations, the first half 6 and the second half 7 of the cummerbund 2 are fastened together to form the cummerbund 2 around a vest 1.

Referring to FIGS. 2, 3, 4, and 5, in some implementations, the cummerbund 2 has a two-piece design with a first half 6 of the cummerbund 2 and a second half 7 of the cummerbund 2. The pull cord 3 may partially reside within a conduit 4 formed through the first half 6 of the cummerbund 2.

Figure 2:
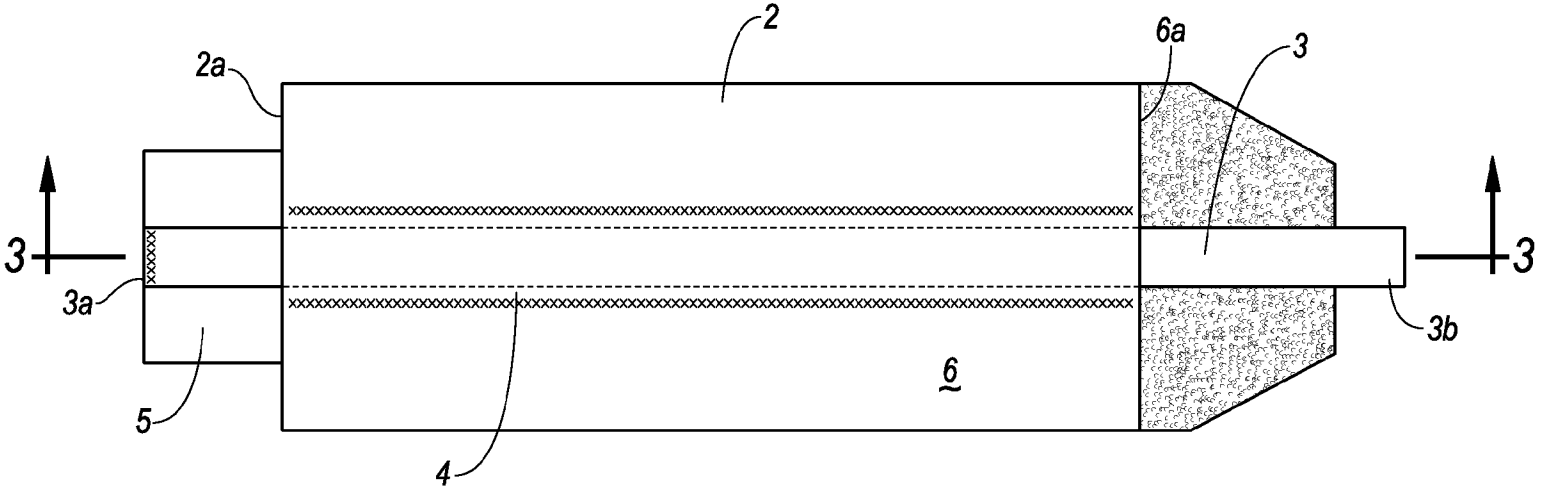
FIG. 2 is a plan view of one portion of the cummerbund of FIGS. 1A and 1B.
Figure 3:
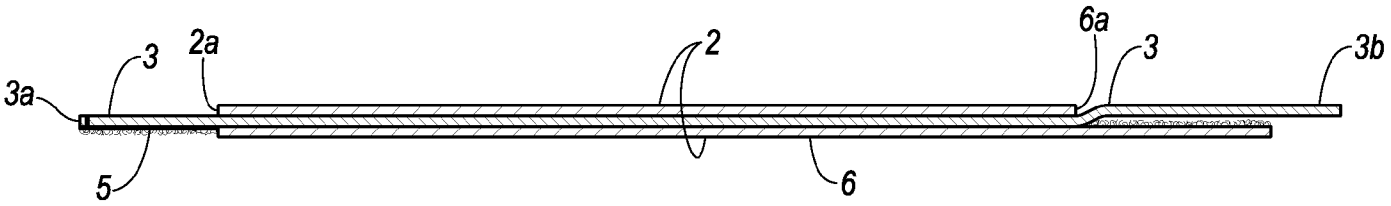
FIG. 3 is a sectional view of the portion of the cummerbund of FIG. 2.

Referring to FIGS. 2 and 3, in some implementations, the first end 2*a* of the cummerbund 2 terminates into a connector 5. The first end 3*a* of the pull cord 3 attaches to the connector 5 at the first end 2*a* of the cummerbund 2.

Figure 4:
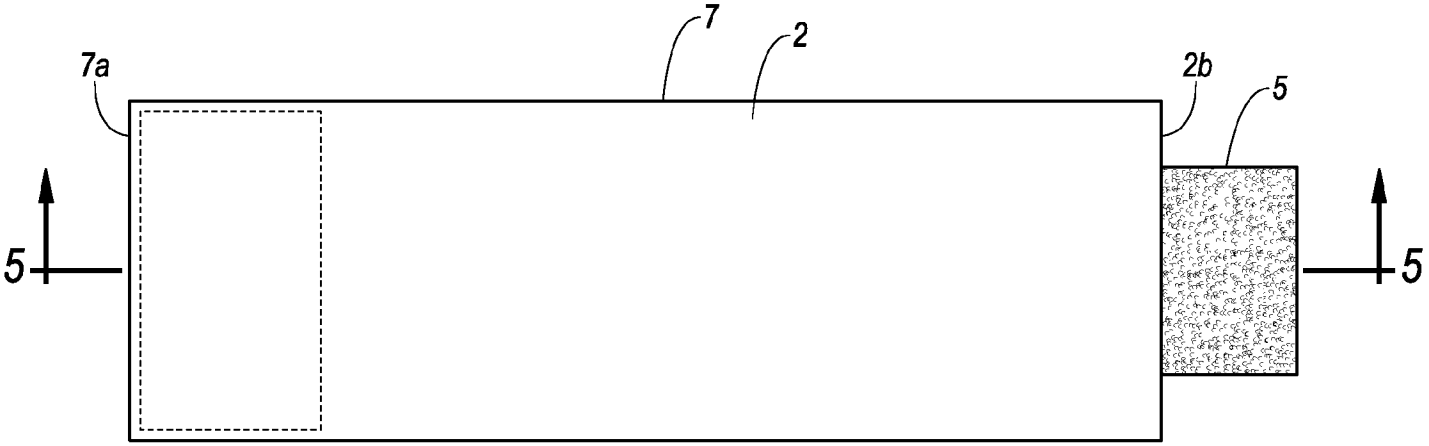
FIG. 4 is a plan view of a second portion of the cummerbund of FIGS. 1A and 1B.
Figure 5:
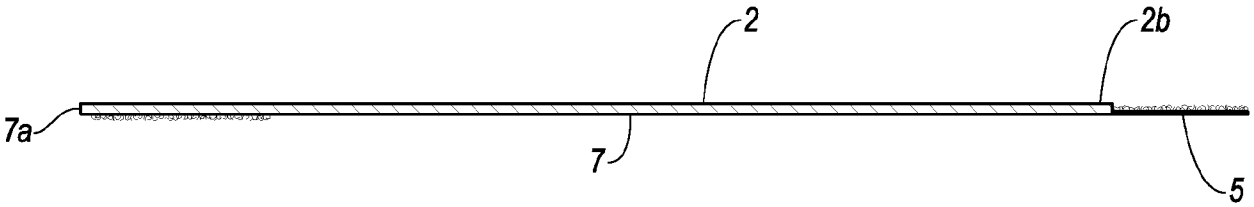
FIG. 5 is a sectional view of the portion of the cummerbund of FIG. 4.

Referring to FIGS. 4 and 5, in some implementations, the second end 2*b* of the cummerbund 2 also terminates into a connector 5. The connector 5 at the second end 2*b* of the cummerbund 2 opposes the connector 5 at the first end 2*a* of the cummerbund 2, with one of these connectors 5 including a hook portion of a hook and loop fastener and the other of these connectors 5 including a loop portion of a hook and loop fastener.

Figure 6:
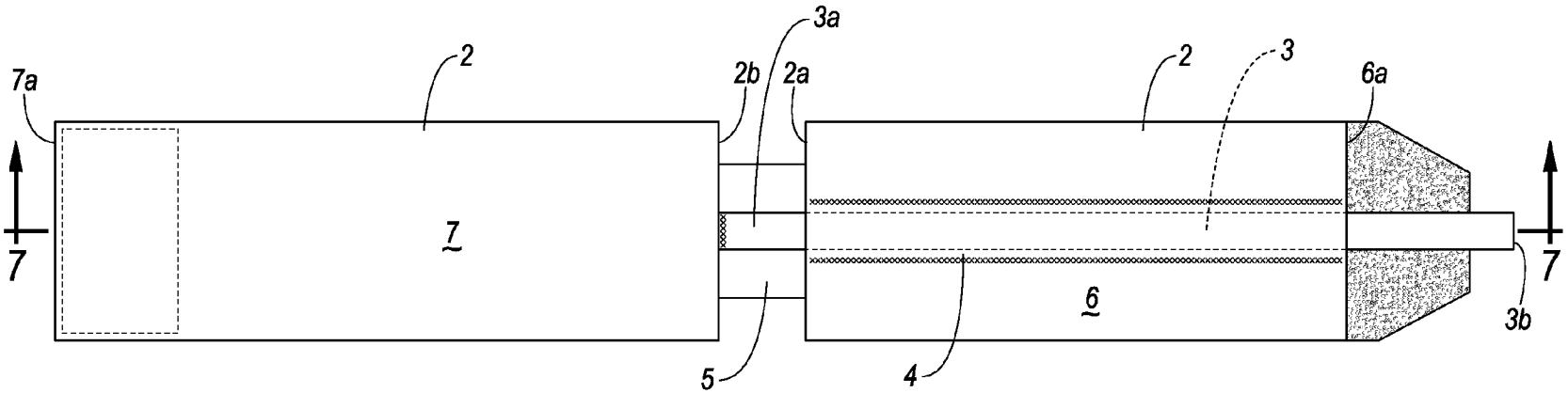
FIG. 6 is a plan view of the cummerbund of FIGS. 1A and 1B.
Figure 7:
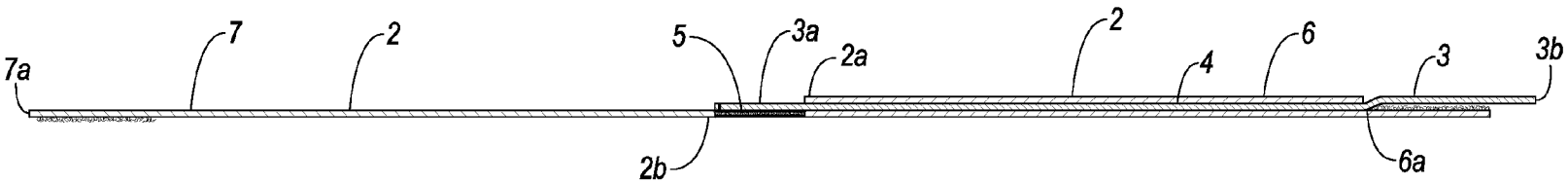
FIG. 7 is a sectional view of the cummerbund of FIG. 6.

Referring to FIGS. 6 and 7, in some implementation, the first half 6 of the cummerbund 2 connects to the second half 7 of the cummerbund 2 when the opposing connectors 5 are fastened.

Referring to FIGS. 2-7, in some implementations, the two-piece design of the cummerbund 2 creates a front end 6*a* of the first half 6 of the cummerbund 2 and a front end 7*a* of the second half 7 of the cummerbund 2.

Figure 8A:
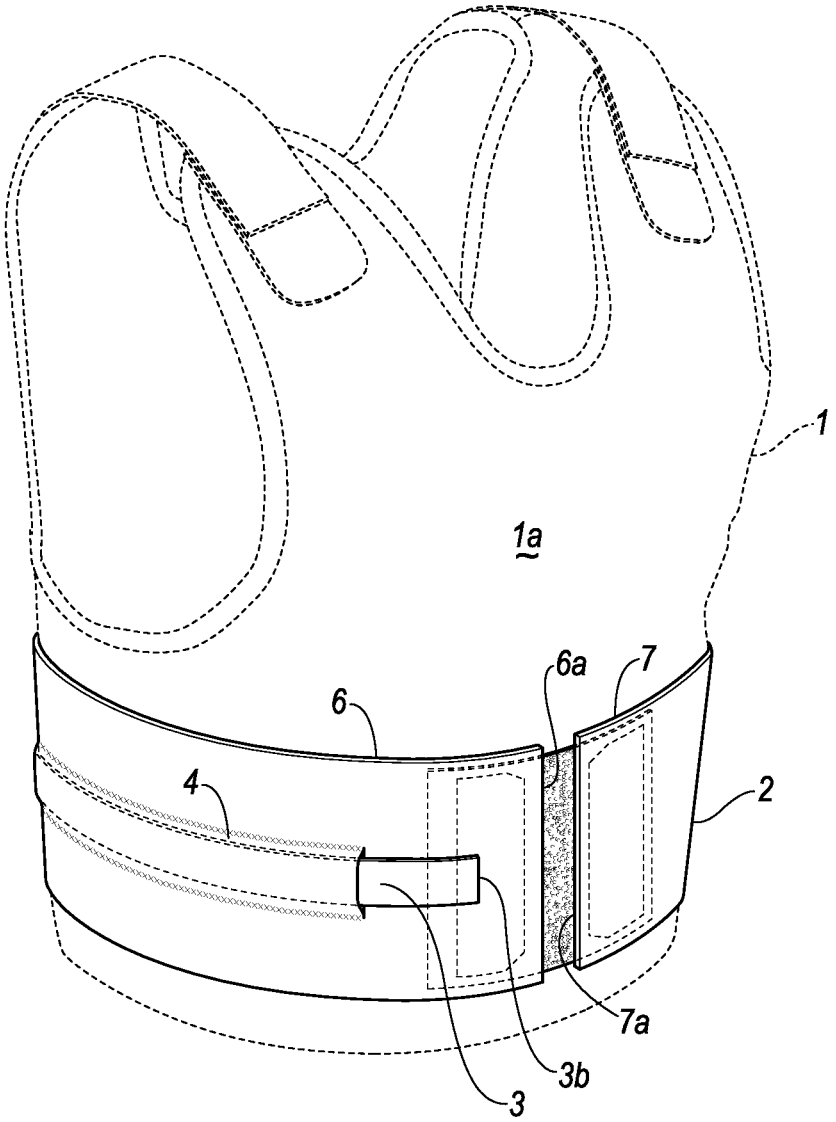
FIG. 8A is an isometric view of the front portion of a vest including a cummerbund that utilizes another exemplary implementation of the quick release fastening system. The front portion of the vest of FIG. 8A includes a connector to which both halves of the cummerbund connect.
Figure 8B:
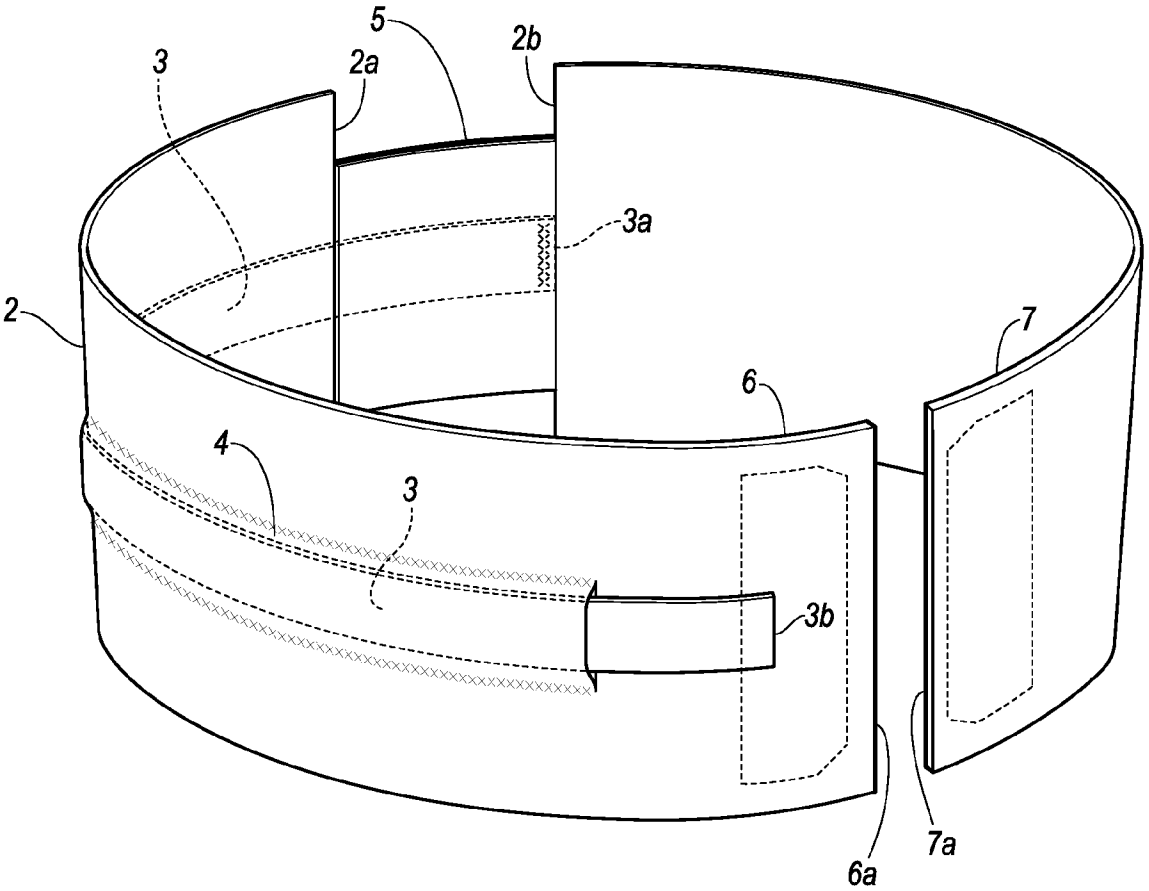
FIG. 8B is an isometric view of the cummerbund of FIG. 8A.

Referring to FIGS. 8A and 8B, in some implementations, the front end 6*a* of the first half 6 of the cummerbund 2 does not fasten to the front end 7*a* of the second half 7 of the cummerbund 2. Instead, a connector field, comprising either a hook portion or a loop portion of a hook and loop fastener, is disposed at the lower end of the front portion 1*a* of the vest 1. Both the front end 6*a* of the first half 6 of the cummerbund 2 and the front end 7*a* of the second half 7 of the cummerbund 2 include either a hook portion or a loop portion of a hook and loop fastener, which engages the connector field disposed on the front portion 1*a* of the vest 1.

Other than FIGS. 8A and 8B, all of the figures that include a cummerbund 2 with a two-piece design show a front end 6*a* of the first half 6 of the cummerbund 2, which fastens to a front end 7*a* of the second half 7 of the cummerbund 2. However, all implementations of the quick release fastening system shown in the figures are also compatible with a cummerbund 2 design in which both the first end 6*a* of the first half 6 of the cummerbund 2 and the first end 7*a* of the second half 7 of the cummerbund 2 fasten directly to a connector disposed on the front portion 1*a* of the vest 1.

Figure 9A:
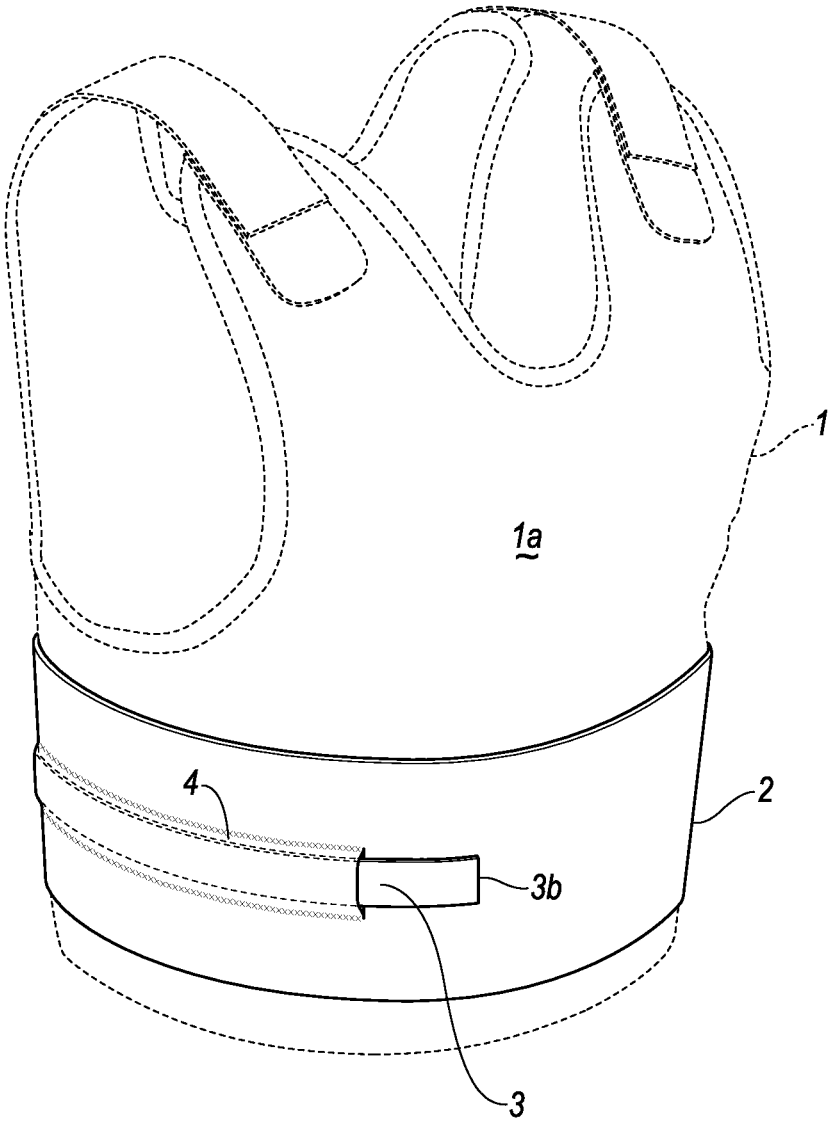
FIG. 9A is an isometric view of the front portion of a wearable article such as a vest including a cummerbund that utilizes another exemplary implementation of the quick release fastening system. The cummerbund of FIG. 9A has a one-piece design.
Figure 9B:
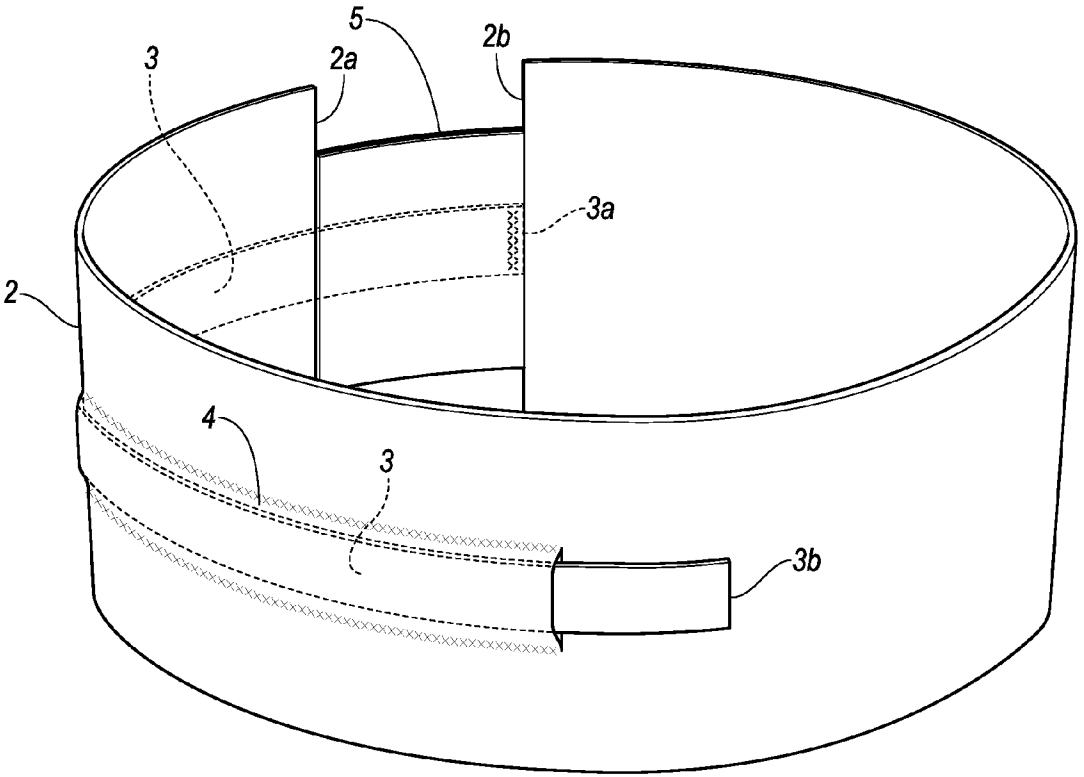
FIG. 9B is an isometric view of the wearable article of FIG. 9A.

Referring to FIGS. 9A and 9B, in some implementations, the cummerbund 2 has a one-piece design, with no fastener at the front portion 1*a* of the vest 1. This one-piece cummerbund 2 utilizes the quick release fastening system to fasten the first end 2*a* of the cummerbund 2 to the second end 2*b* of the cummerbund 2 with the connector 5.

Other than FIGS. 9A and 9B, all of the figures show a cummerbund 2 having a two-piece design. However, all implementations of the quick release fastening system shown in the figures are also compatible with a cummerbund 2 having a one-piece design.

The cummerbund 2, regardless of whether it is of a one-piece design or a two-piece design, may be affixed to the front portion 1*a* of the vest 1, fastened to the front portion 1*a* of the vest 1 and capable of release, or unattached to the front portion 1*a* of the vest 1.

Figure 10:
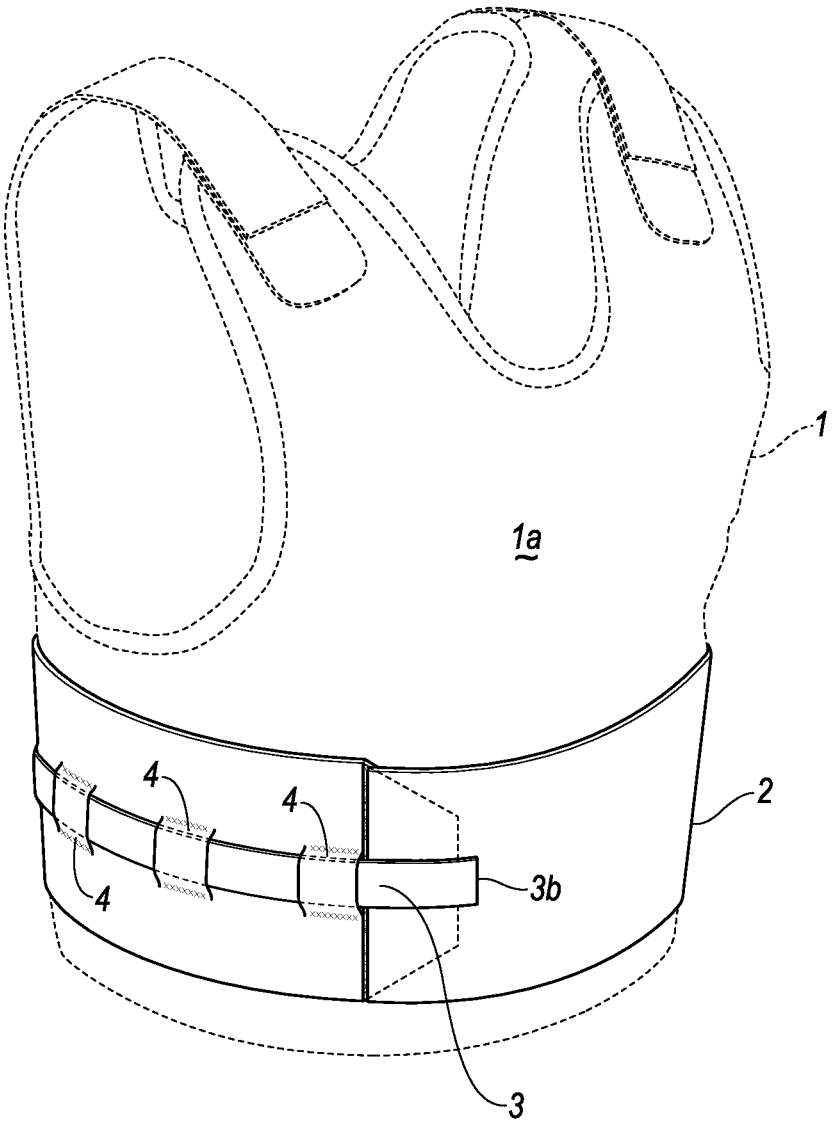
FIG. 10 is an isometric view of the front portion of a wearable article such as a vest including a cummerbund that utilizes another exemplary implementation of the quick release fastening system. The implementation of FIG. 10 illustrates an alternative type of conduit in which the pull cord resides.

Referring to FIG. 10, in some implementations, the conduit 4 has a non-continuous design.

Other than FIG. 10, all of the figures show a conduit 2 having a continuous design. However, all implementations of the quick release fastening system shown in the figures are also compatible with a conduit having a non-continuous design.

Figure 11A:
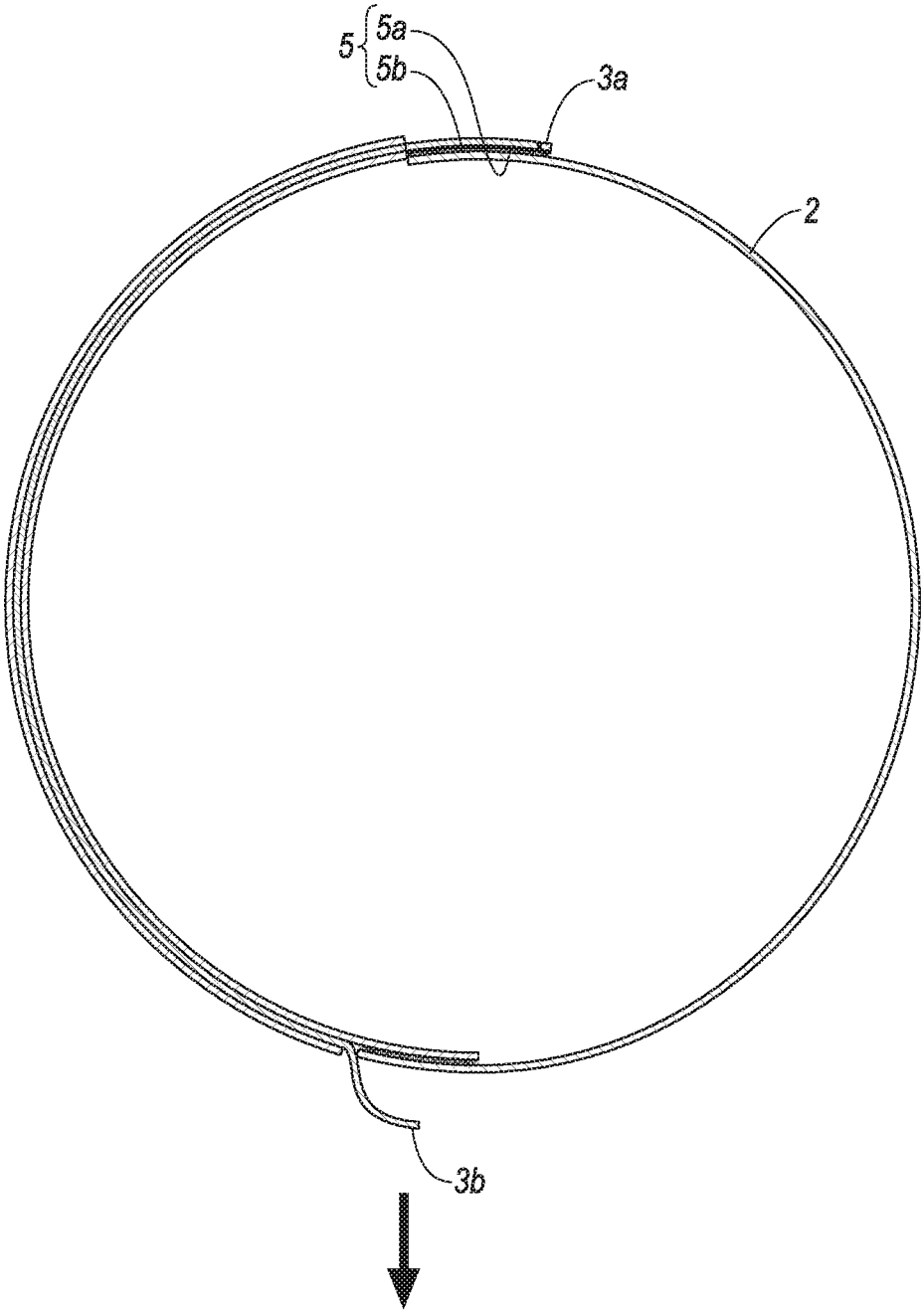
FIG. 11A is a top view of the cummerbund of FIGS. 1A and 1B.

Referring to FIG. 11A, in some implementations, the user may engage the quick release fastening system by a frontal pull of the second end 3*b* of the pull cord 3 for peeling a peelable portion 5*a* of the connector 5 from a fixed portion 5*b* of the connector.

Figure 11B:
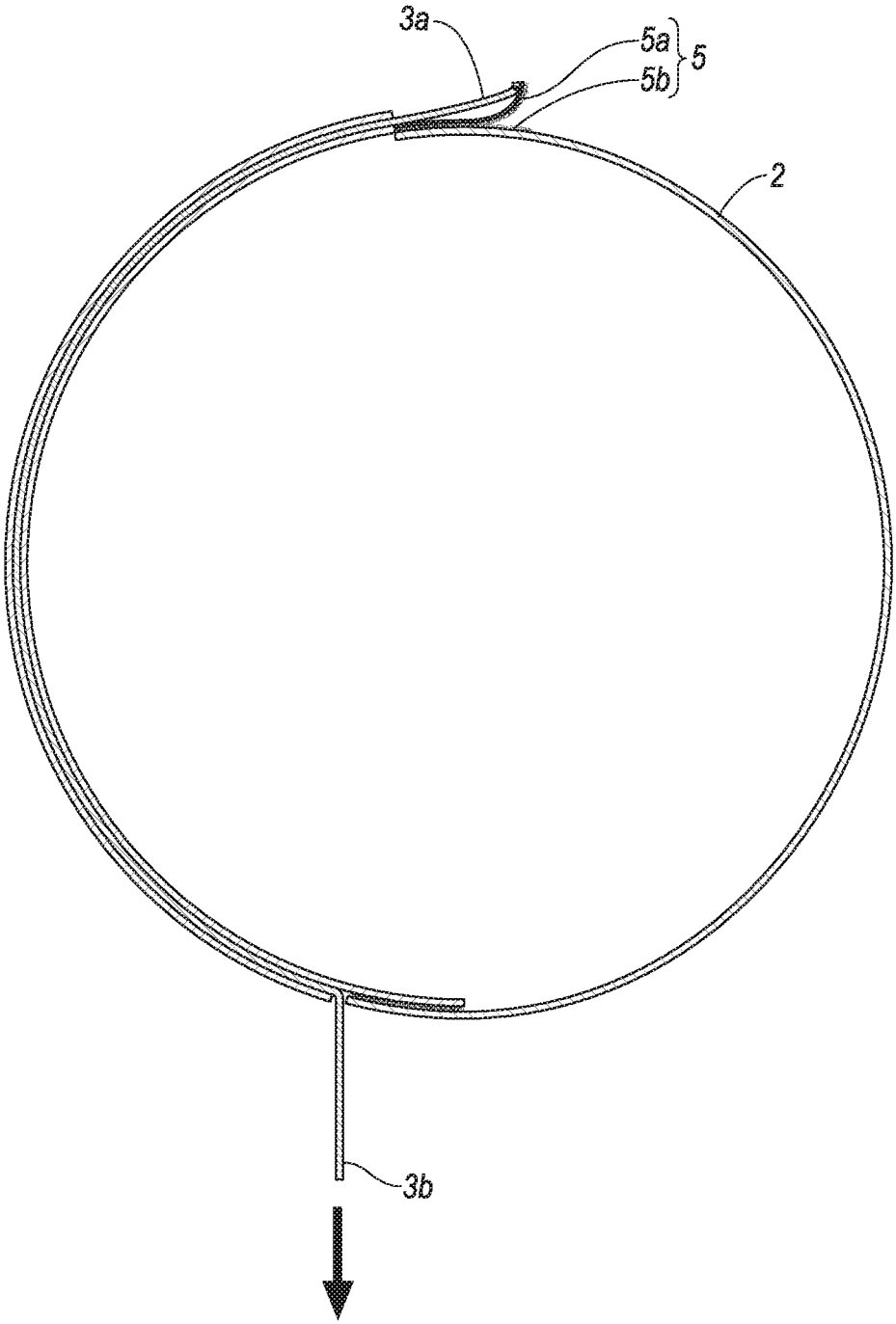
FIG. 11B is a top view of the cummerbund of FIGS. 1A and 1B.

Referring to FIG. 11B, in some implementations, engaging the quick release fastening system with a frontal pull of the second end 3*b* of the pull cord 3 results in the first end 3*a* of the pull cord 3 peeling the peelable portion 5*a* of the connector 5 from the fixed portion 5*b* of the connector 5 to disengage the hook and loop fastener.

Figure 11C:
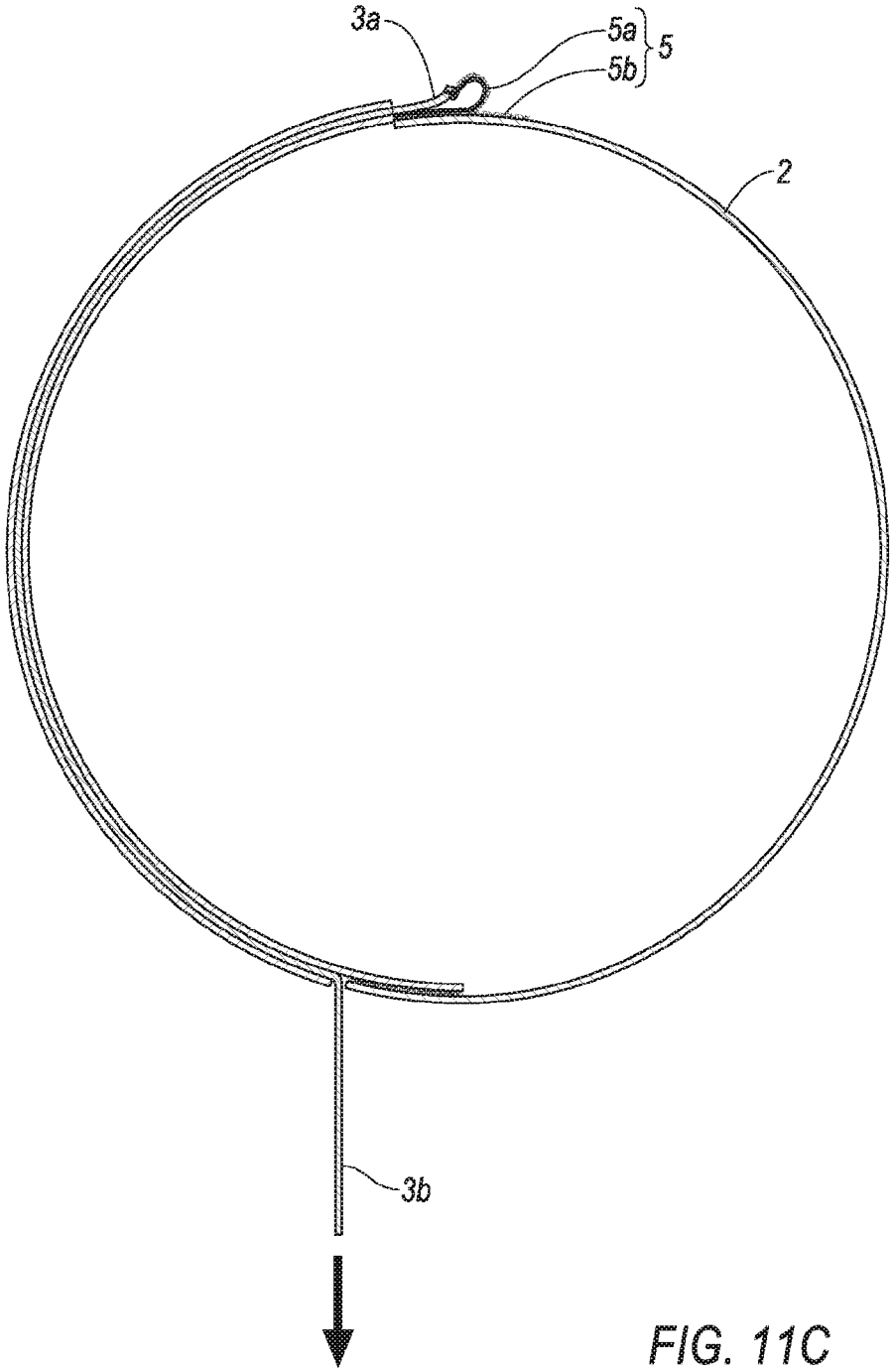
FIG. 11C is a top view of the cummerbund of FIGS. 1A and 1B.

Referring to FIG. 11C, in some implementations, as the quick release fastening system is continued to be engaged, the first end 3*a* of the pull cord 3 continues to peel back the peelable portion 6*a* of the connector 5 from the fixed portion 5*b* of the connector 5.

Figure 11D:
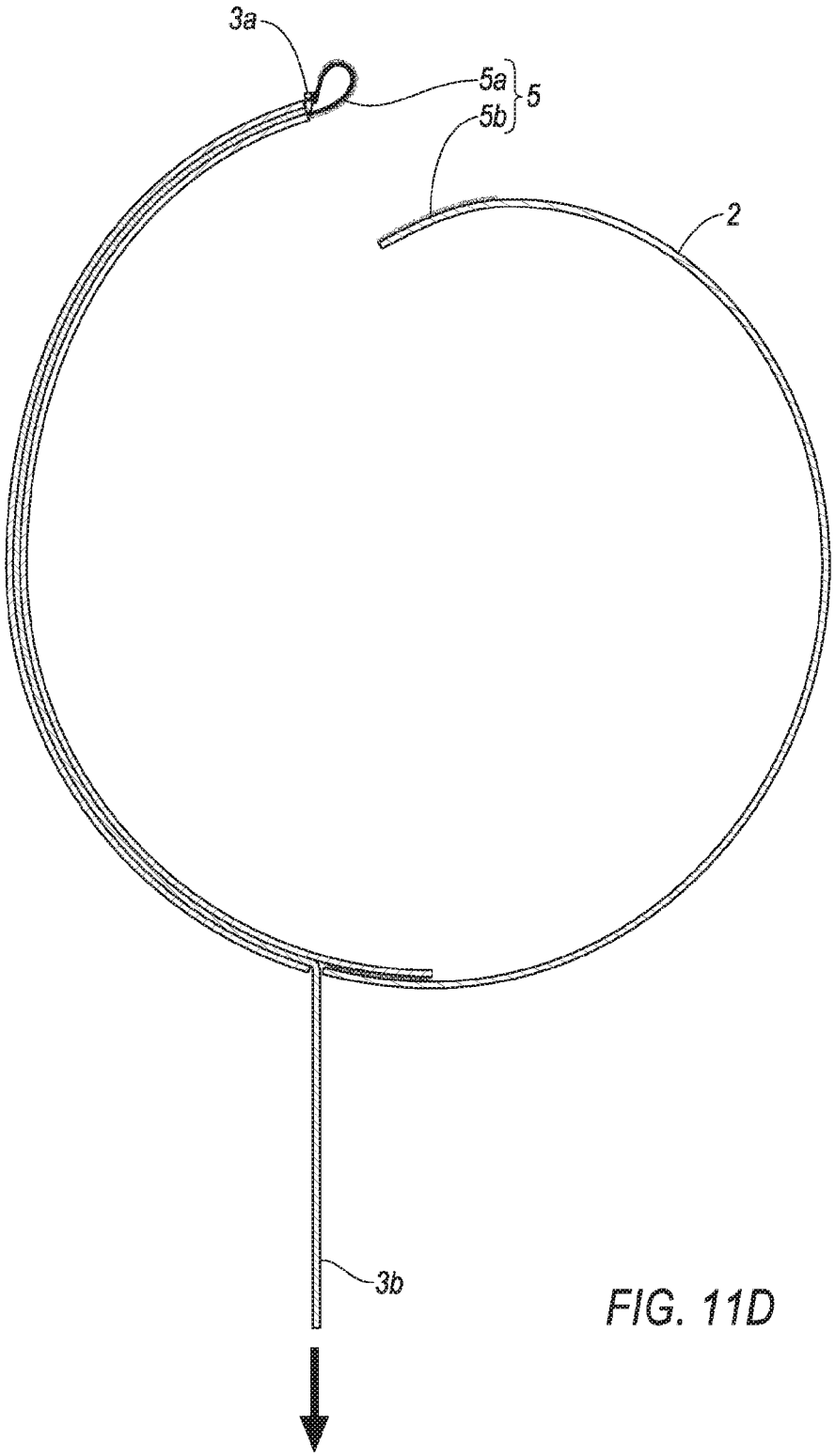
FIG. 11D is a top view of the cummerbund of FIGS. 1A and 1B.

Referring to FIG. 11D, in some implementation, when the quick release fastening system is fully engaged, the first end 3*a* of the pull cord 3 has receded to the opening of the conduit 4 and the peelable portion 5*a* of the connector 5 has been fully peeled from the fixed portion 5*b* of the connector 5, resulting in complete disengagement of the hook and loop fastener. When the fastener is completely disengaged, release has occurred and the first half 6 of the cummerbund 2 becomes disconnected from the second half 7 of the cummerbund.

Figure 12A:
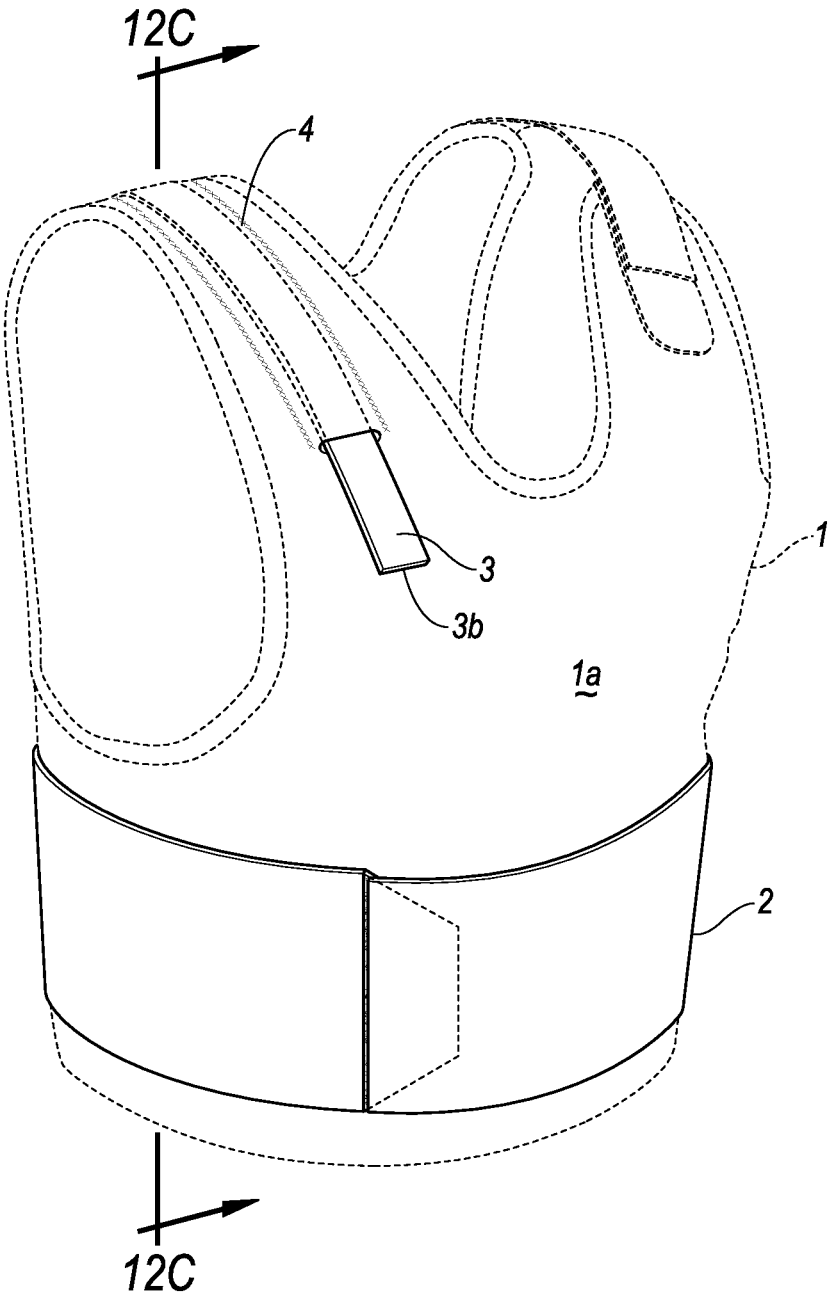
FIG. 12A is an isometric view of the front portion of a vest including a cummerbund that utilizes another exemplary implementation of the quick release fastening system.
Figure 12B:
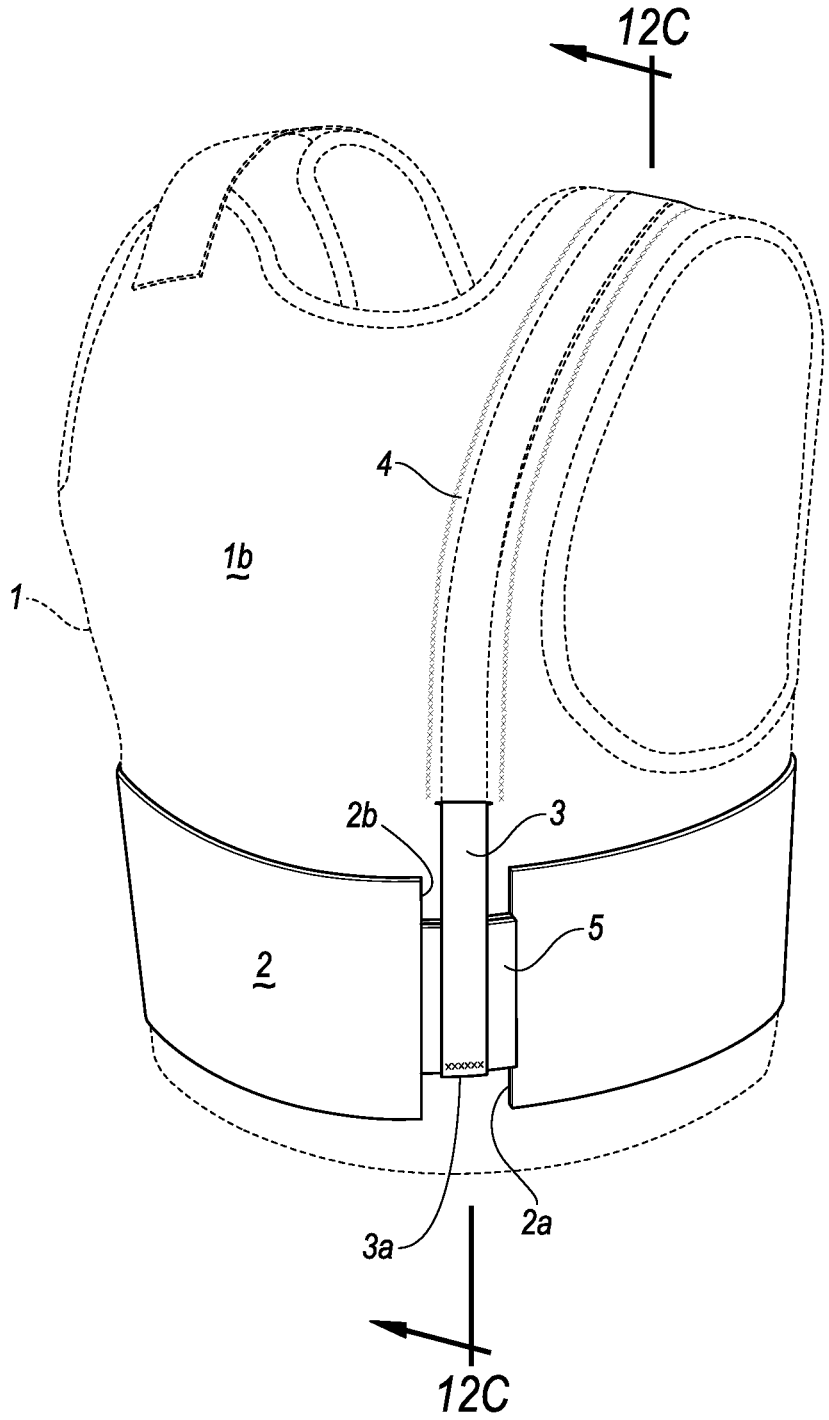
FIG. 12B is an isometric view of the back portion of a vest including a cummerbund that utilizes another exemplary implementation of the quick release fastening system.
Figure 12C:
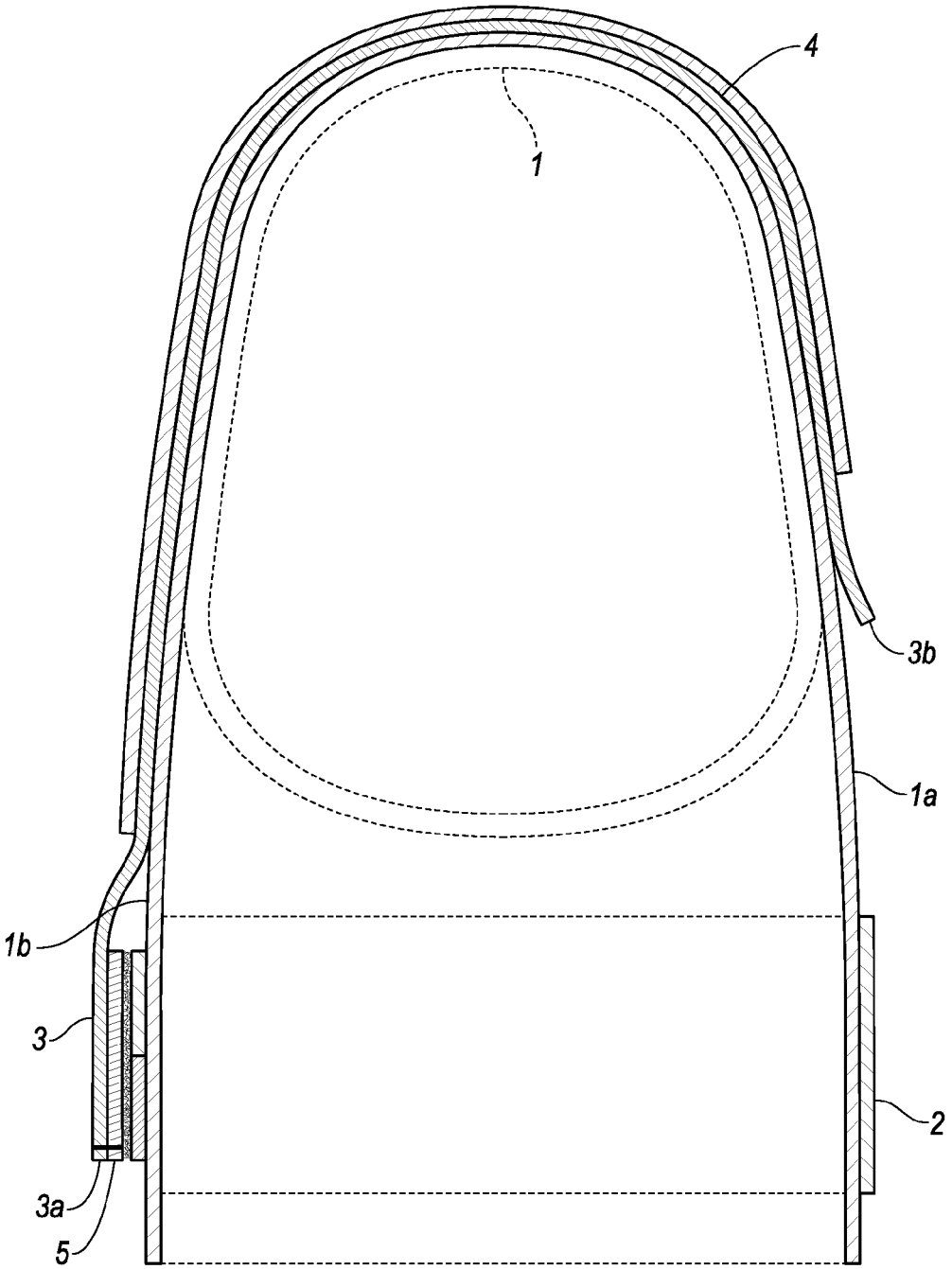
FIG. 12C is a sectional view of the vest of FIGS. 12A and 12B.

Referring to FIGS. 12A, 12B, and 12C, in some implementations, the conduit 4 in which the pull cord 3 partially resides is formed through the front portion 1*a* and the back portion 1*b* of the vest 1.

The second end 3*b* of the pull cord 3 may reside proximate to the front portion 1*a* of the vest 1. The user may engage the quick release mechanism of the fastening system with a frontal pull of the second end 3*b* of the pull cord 3. Engagement of the quick release mechanism causes the first end 3*a* of the pull cord 3 to peel the connector 5 at the back portion 1*b* of the vest 1.

The front portion 1*a* and the back portion 1*b* of the vest 1 may be attached at the shoulder of the vest 1 with a continuous connection or a strapped connection. In all implementations of the quick release fastening system, either type of connection at the shoulder of the vest 1 can be utilized without affecting the fastening system.

Figure 13A:
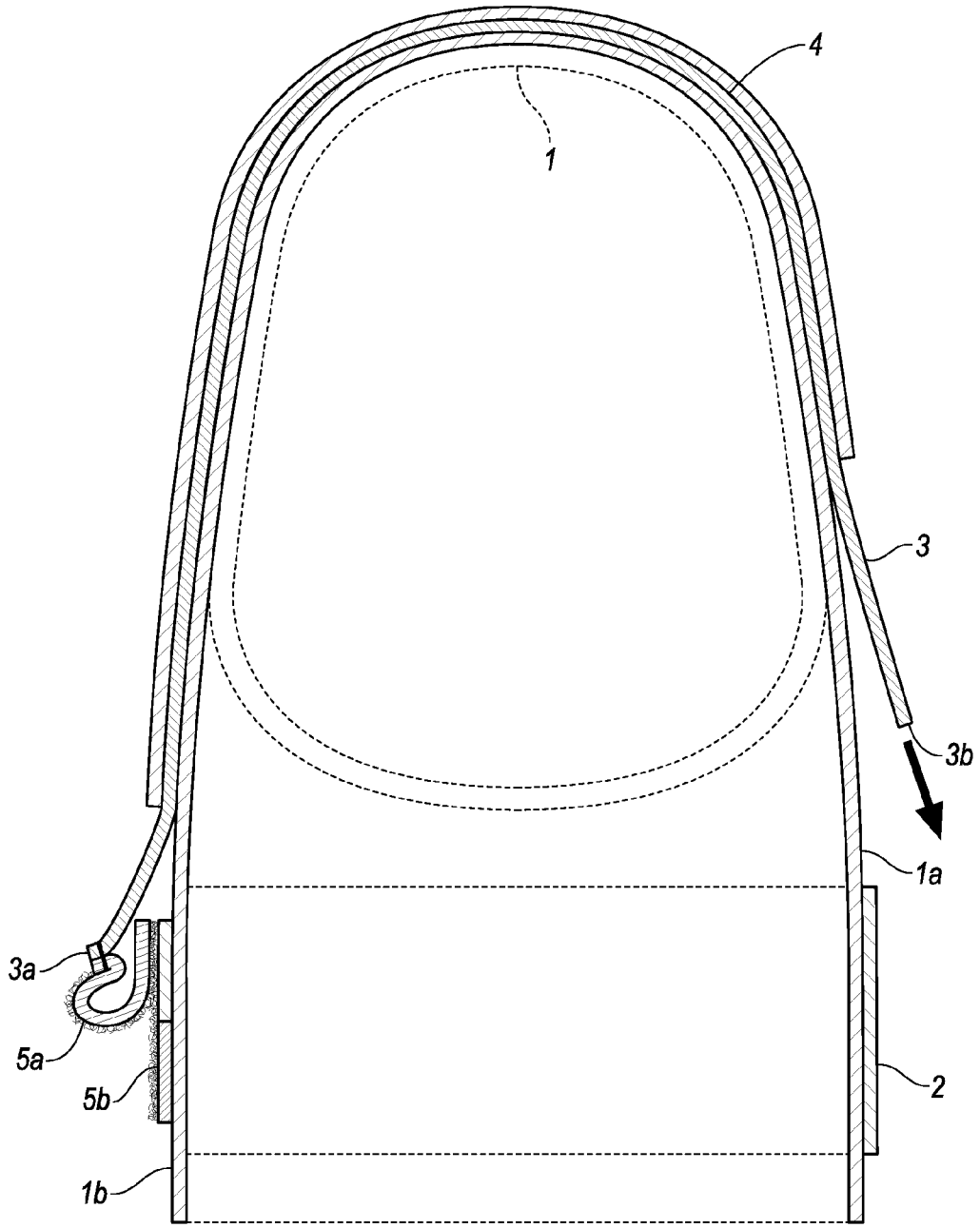
FIG. 13A is a sectional view of that vest of FIGS. 12A and 12B.

Referring to FIG. 13A, in some implementations, the user may engage the quick release mechanism by a frontal pull of the second end 3*b* of the pull cord 3. This frontal pull causes in the first end 3*a* of the pull cord 3 to vertically peel the pull tab portion 5*a* of the connector 5 to disengage the hook and loop fastener.

Figure 13B:
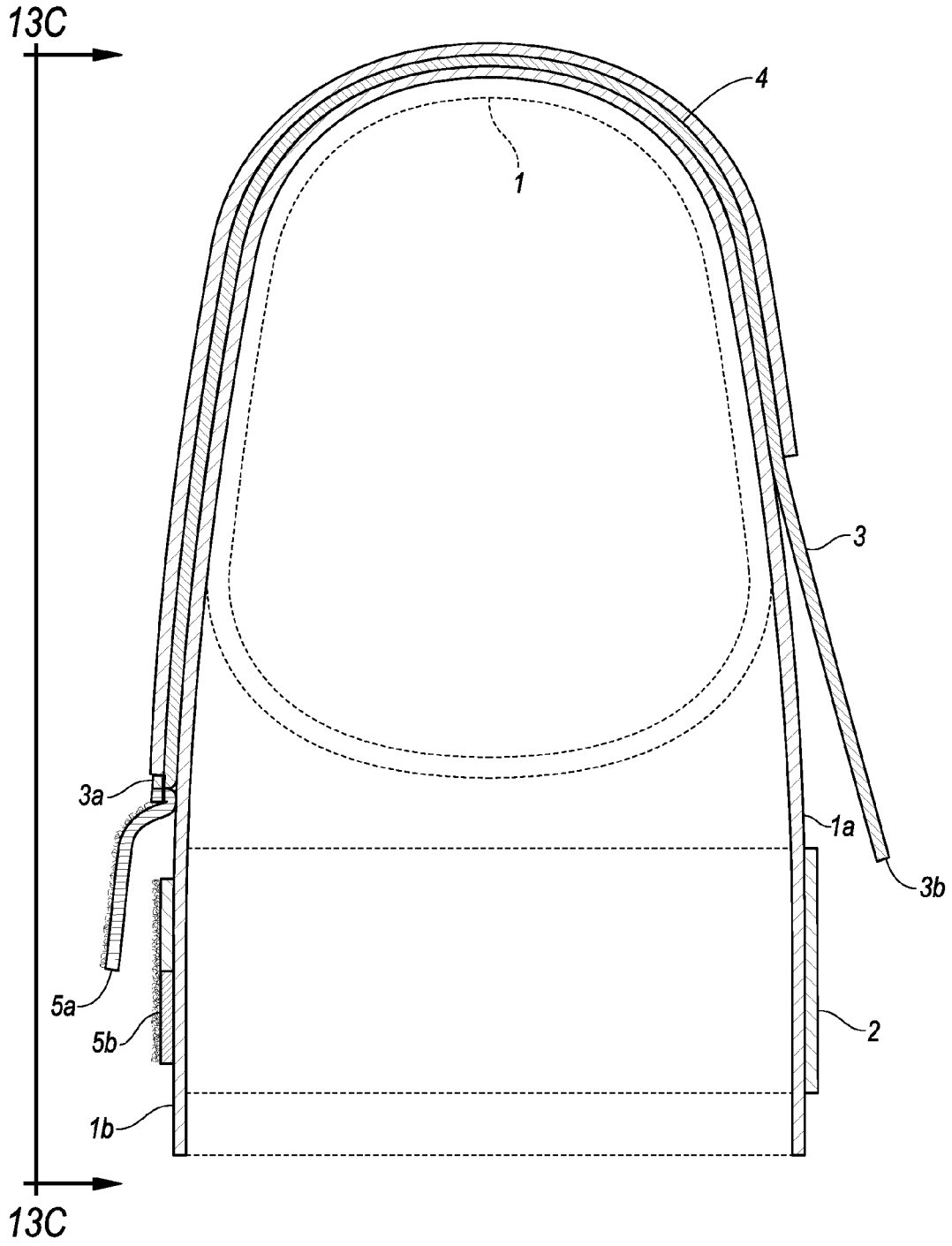
FIG. 13B is a sectional view of that vest of FIGS. 12A and 12B.

Referring to FIG. 13B, in some implementations, when the quick release mechanism is fully engaged, the first end 3*a* of the pull cord 3 has vertically receded to the opening of the conduit 4 and the connector 5 has been fully peeled. The quick release mechanism has fully disengaged the hook and loop fastener.

Figure 13C:
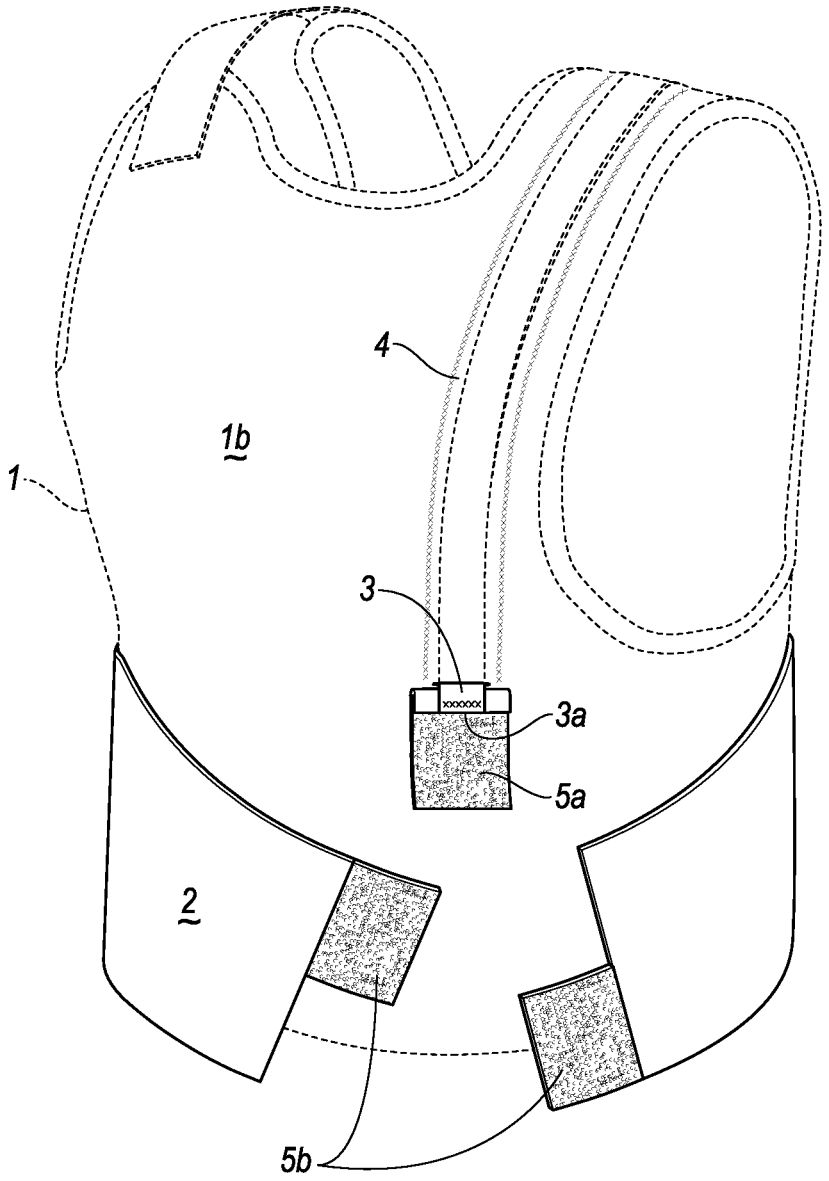
FIG. 13C is an isometric view of the back portion of the vest of FIGS. 12A and 12B.

Referring to FIG. 13C, in some implementations, when the quick release mechanism is fully engaged, the cummerbund 2 is completely disconnected at the back portion 1*b* of the vest 1.

The cummerbund portion 5*b* of the connector 5 consists of two segments. One segment is attached to the first end 2*a* of the cummerbund 2. The other segment is attached to the second end 2*b* of the cummerbund 2. When fully peeled, the pull tab portion 5*a* of the connector 5 is completely disengaged from both segments of the cummerbund portion 5*b* of the connector 5.

The two segments of the cummerbund portion 5*b* of the connector 5 can be divided vertically, horizontally, or at any angle allowing for the pull tab portion 5*a* of the connector 5 to securely fasten to both segments of the cummerbund portion 5*b* of the connector 5. The implementation in FIG. 13C illustrates a horizontal division between the segments. The implementation in FIG. 15D illustrates a vertical division between the segments.

Figure 14A:
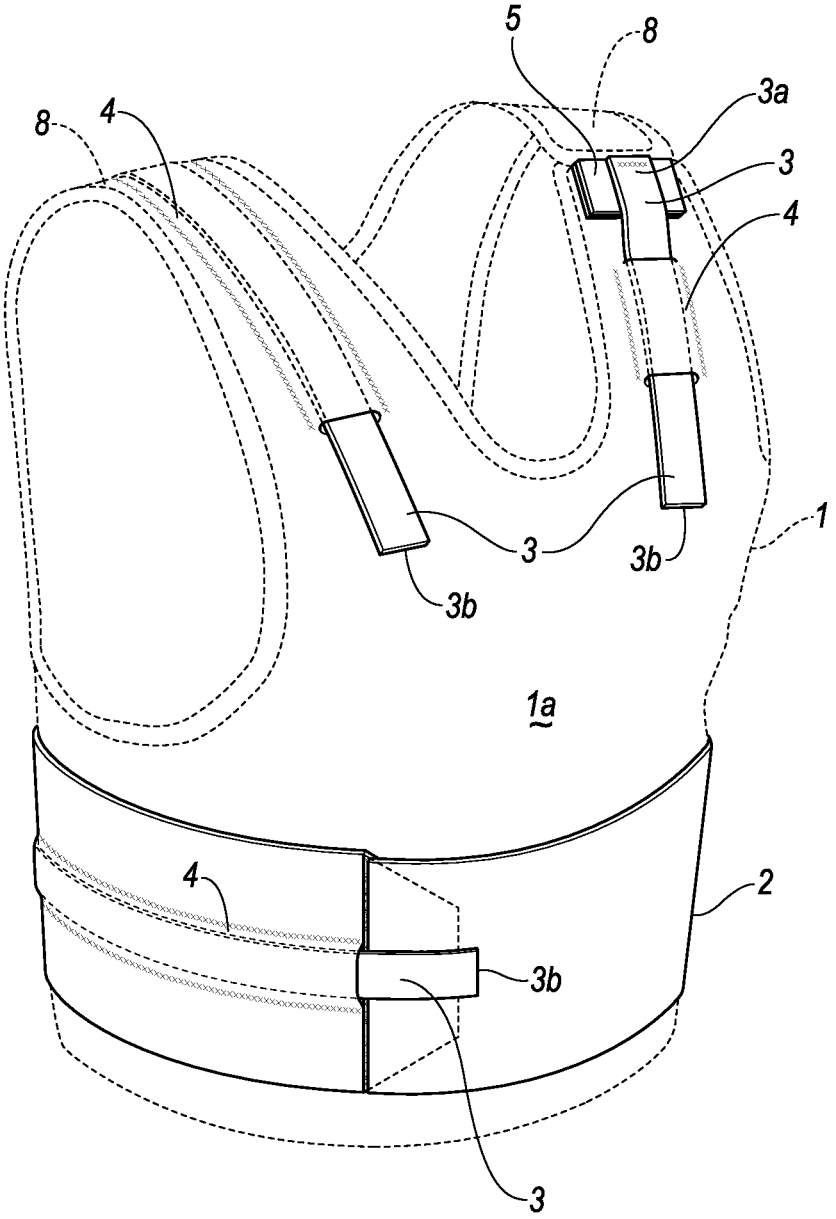
FIG. 14A is an isometric view of the front portion of a vest that utilizes three exemplary implementations of the quick release fastening system. One exemplary implementation is utilized for fastening and releasing the cummerbund, and two exemplary implementations are utilized for fastening and releasing the front portion the vest to the back portion of the vest.
Figure 14B:
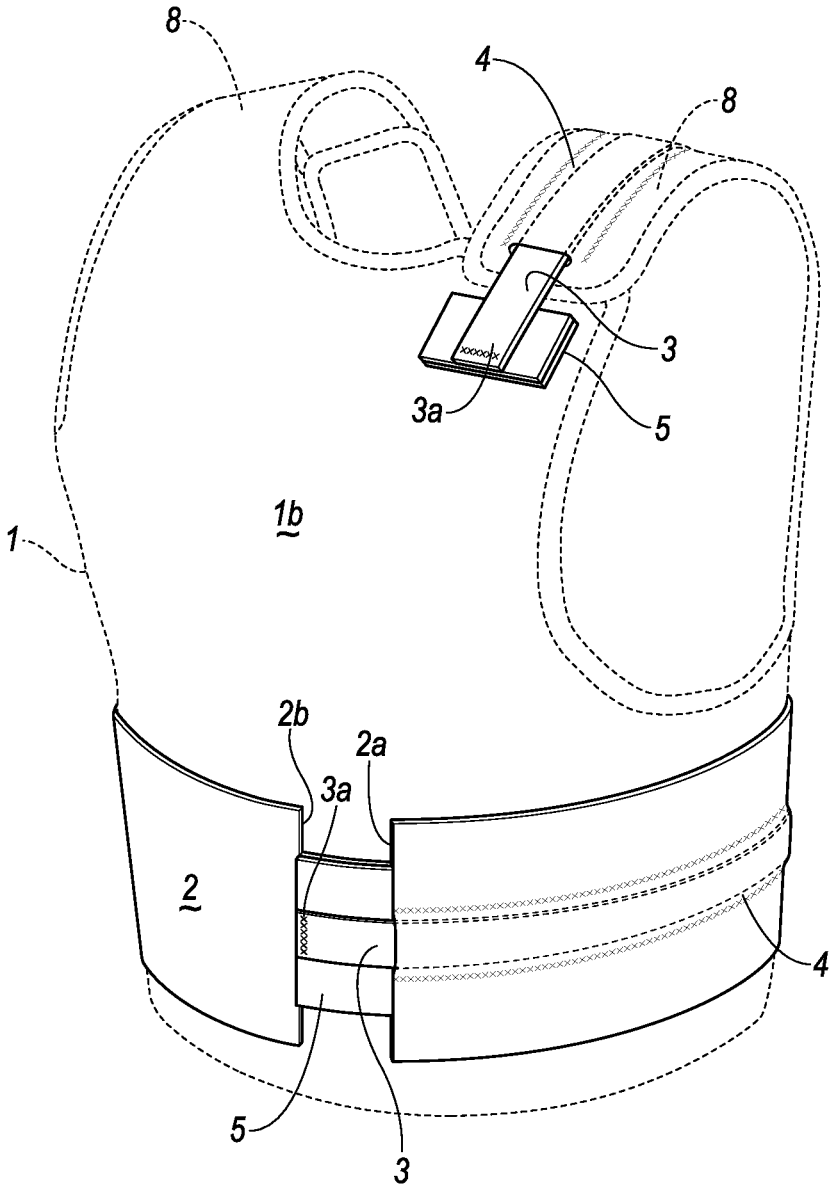
FIG. 14B is an isometric view of the back portion of a vest that utilizes three exemplary implementations of the quick release fastening system. One exemplary implementation is utilized for fastening and releasing the cummerbund, and two exemplary implementations are utilized for fastening and releasing the front portion the vest to the back portion of the vest.

Referring to FIGS. 14A and 14B, in some implementations, the quick release fastening system is utilized to fasten and release the front portion 1*a* of the vest 1 and the back portion 1*b* of the vest 1. The quick release fastening system can be utilized at either one shoulder strap 8 or both shoulder straps 8. When the system is utilized to connect the front portion 1*a* of the vest 1 to the back portion 1*b* of the vest 1, an additional quick release fastening system can optionally also be utilized on the cummerbund 2.

Each shoulder strap 8 has one end that is attached to either the front portion 1*a* of the vest 1 or the back portion 1*b* of the vest 1. The other end of each shoulder strap terminates into a connector 5, which corresponds to an opposing connector 5. The opposing connector 5 is affixed to either the front portion 1*a* of the vest 1 or the back portion 1*b* of the vest 1.

The attachment of the shoulder strap 8 to either the front portion 1*a* of the vest or the back portion 1*b* of the vest can be accomplished in a number of ways. The shoulder strap 8 can be a separate component of the vest 1 that is permanently affixed or securely fastened to either the front portion 1*a* of the vest 1 or the back portion 1*b* of the vest 1. The shoulder strap 8 can also be a continuation of either the front portion 1*a* of the vest 1 or the back portion 1*b* of the vest 1.

A conduit 4 in which a pull cord 3 partially resides is formed through each shoulder strap 8 of the vest 1. A pull cord 3, with an opposing first end 3*a* and second end 3*b*, resides partially within the conduit 4. The first end 3*a* of the pull cord 3 is affixed to the connector 5. The second end 3*b* of the pull cord 3 extends from the conduit 4 to reside at the front portion 1*b* of the vest 1.

The second end 3*b* of each pull cord 3 resides proximate to the front portion 1*a* of the tactical vest 1. The user may engage the quick release mechanism with a frontal pull of the second end 3*b* of each pull cord 3. Engagement of the quick release mechanism causes the first end 3*a* of each pull cord 3 to disengage the connector 5 between the shoulder strap 8 and the back portion 1*b* of the tactical vest 1.

Figure 15A:
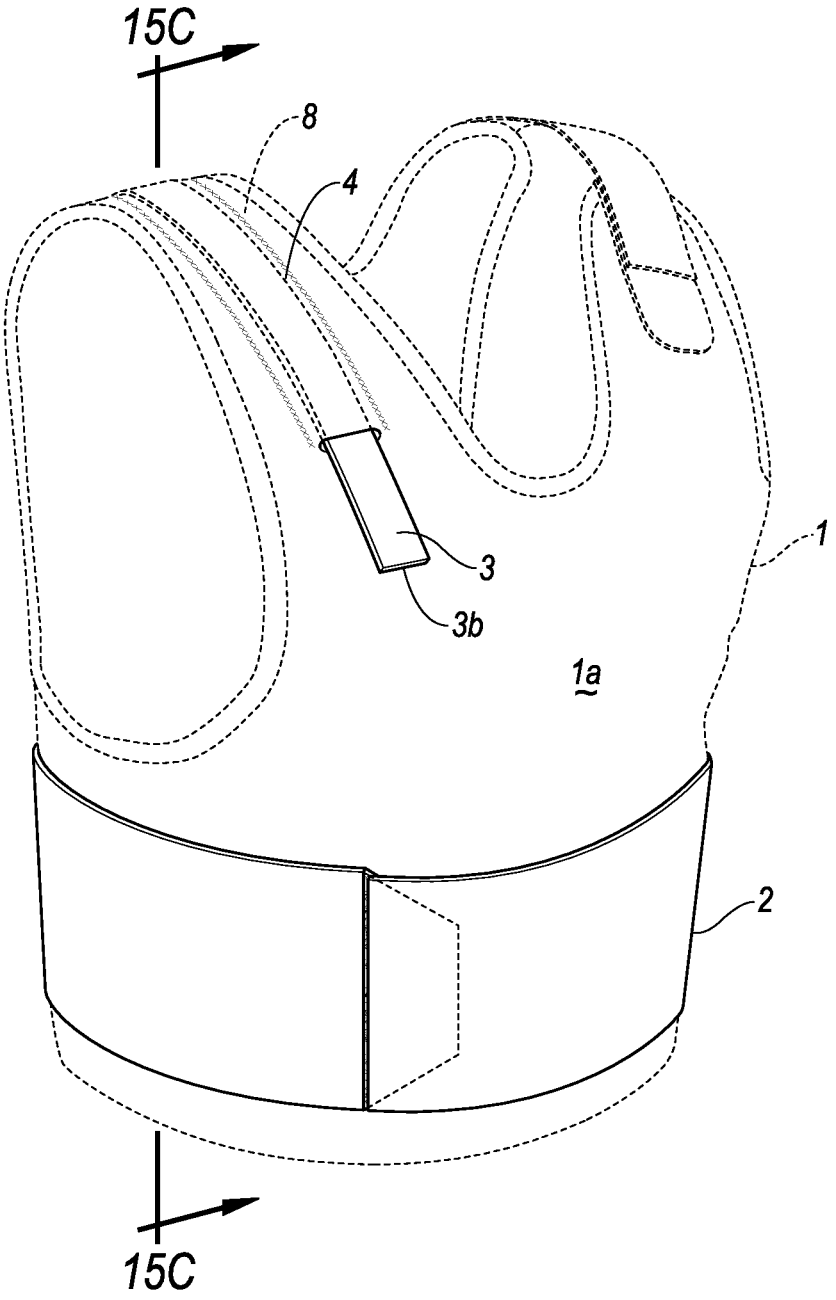
FIG. 15A is an isometric view of the front portion of a vest that utilizes an exemplary implementation of the quick release fastening system.
Figure 15B:
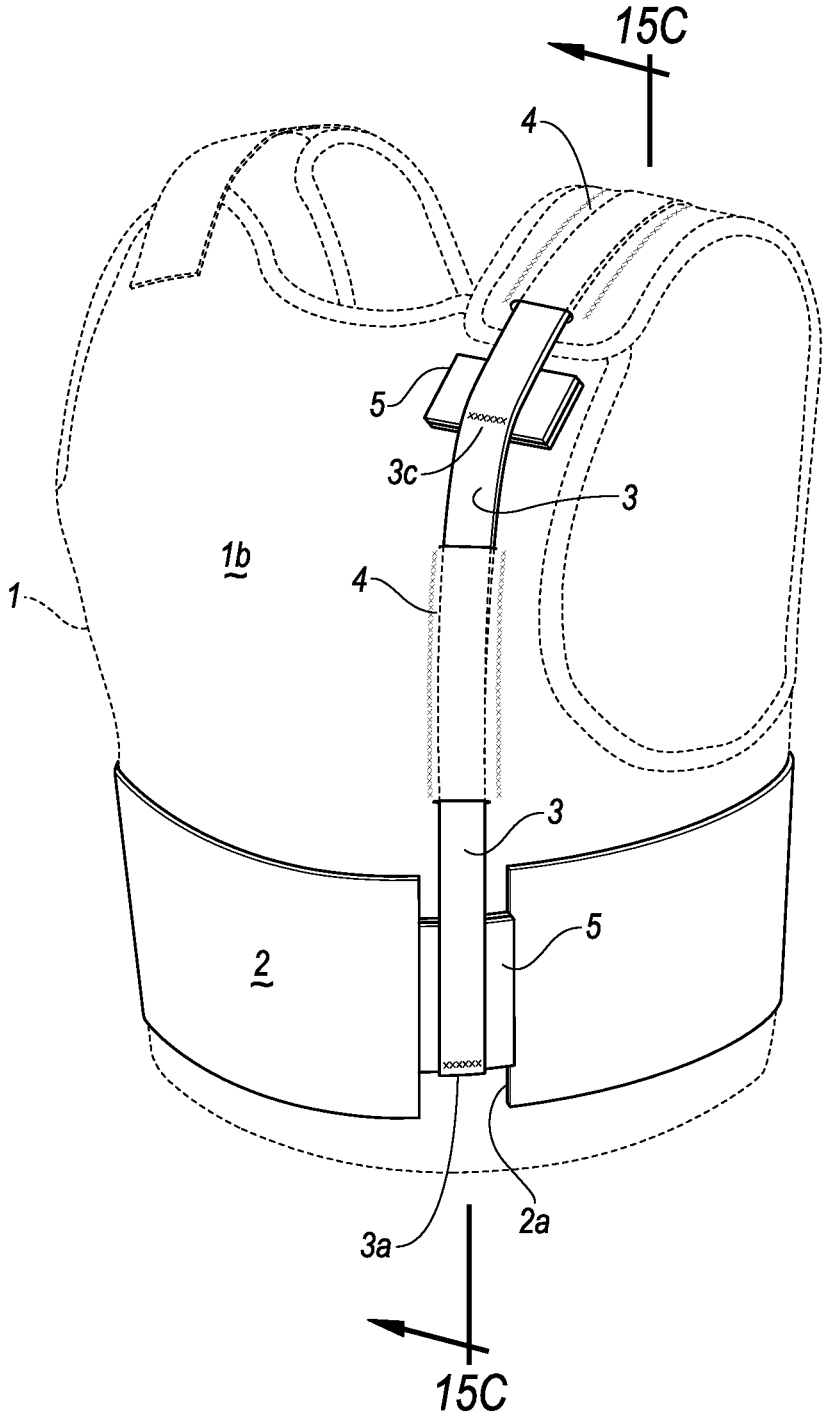
FIG. 15B is an isometric view of the back portion of a vest that utilizes an exemplary implementation of the quick release fastening system.
Figure 15C:
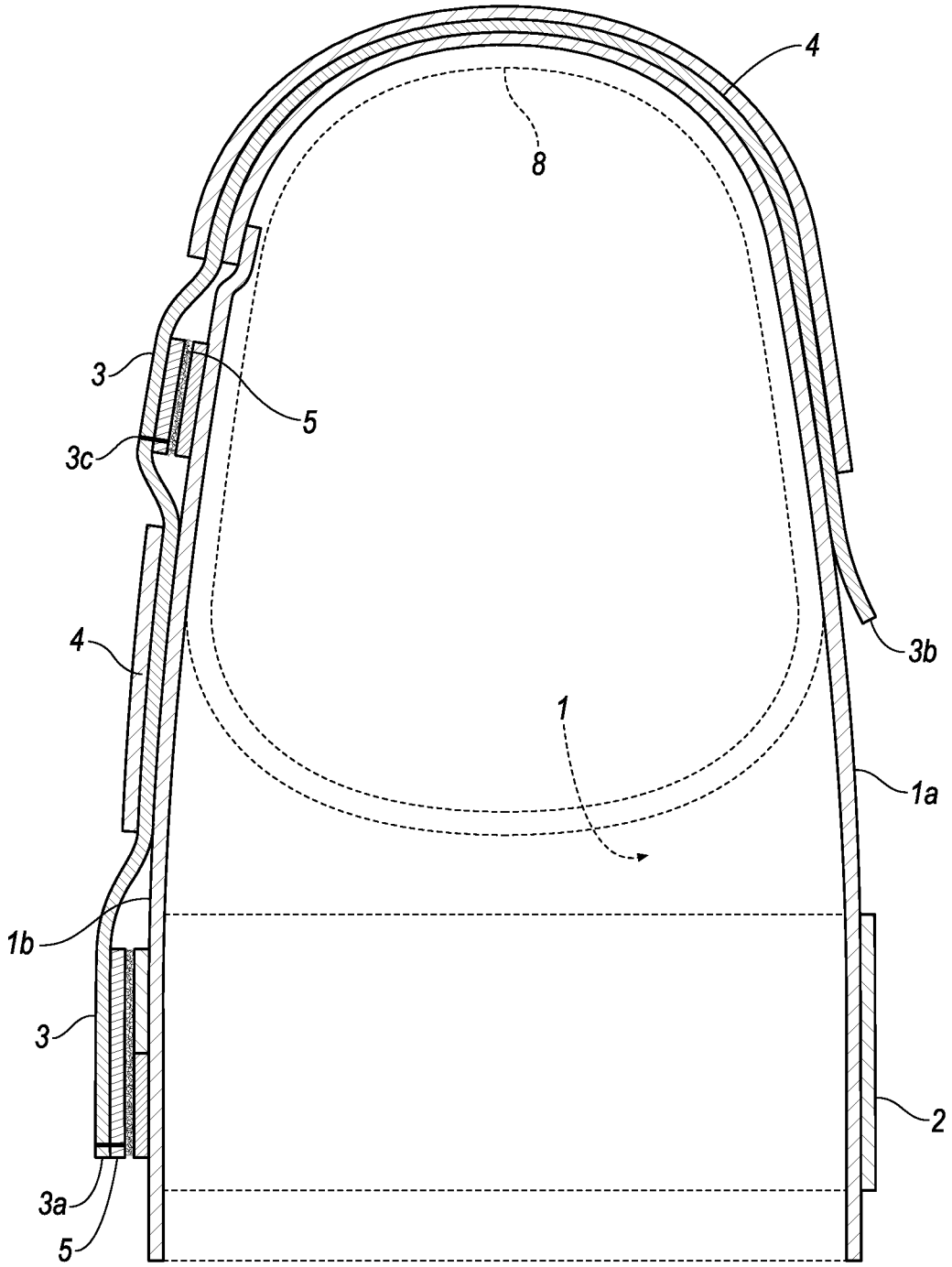
FIG. 15C is a sectional view of the vest of FIGS. 15A and 15B.
Figure 15D:
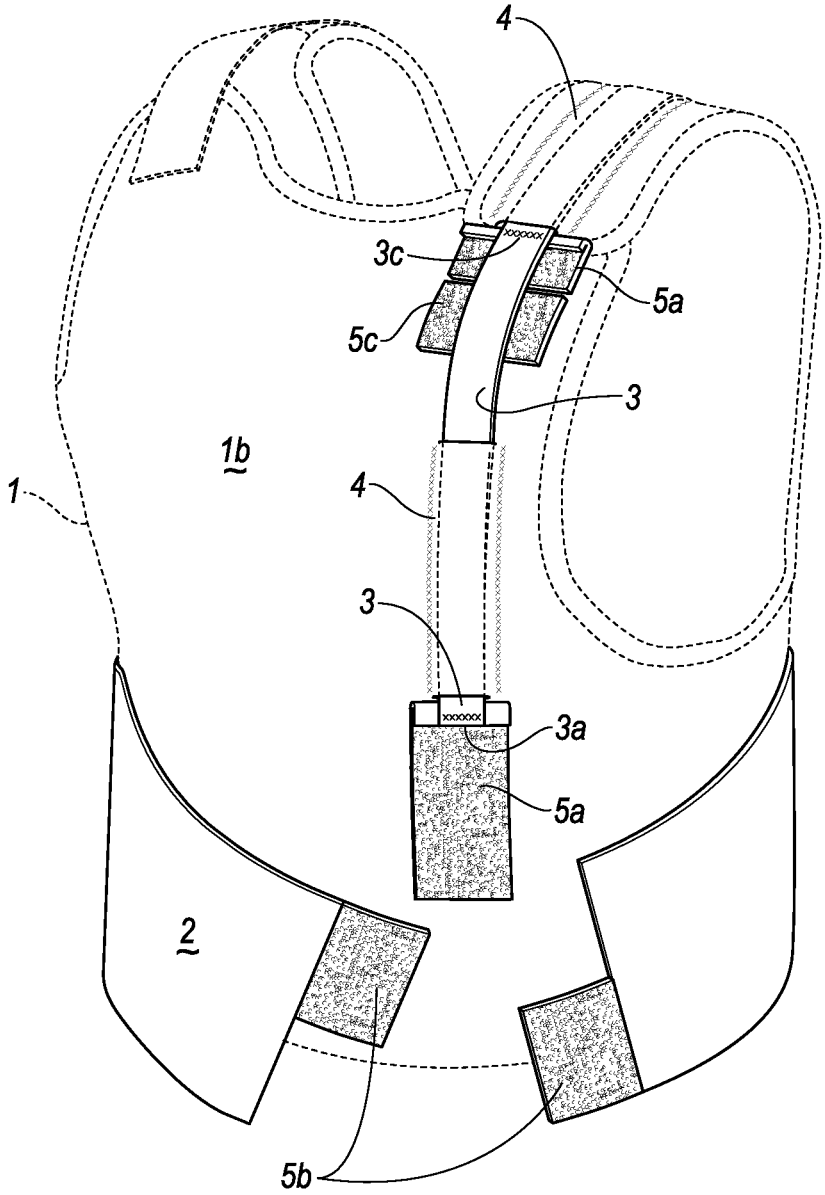
FIG. 15D is an isometric view of the back portion of the vest of FIGS. 15A and 15B.

Referring to FIGS. 15A, 15B, and 15C, in some implementations, a single quick release fastening system is utilized to simultaneously disengage two hook and loop fasteners by peeling a first connector 5 at the first end 2*a* of the cummerbund 2 and a second connector 5 at a shoulder strap 8 of the vest 1.

A conduit 4, in which a single pull cord 3 partially resides, is formed partially through the front portion 1*a* and the shoulder strap 8 of the vest 1 and partially through the back portion 1*b* of the vest 1. The pull cord 3 is attached to the connector 5 of the shoulder strap 8 of the vest 1 at a non-end attachment 3*c* of the pull cord 3 and the first end 3*a* of the pull cord 3 is also attached to the connector 5 at the first end 2*a* of the cummerbund.

Figure 15E:
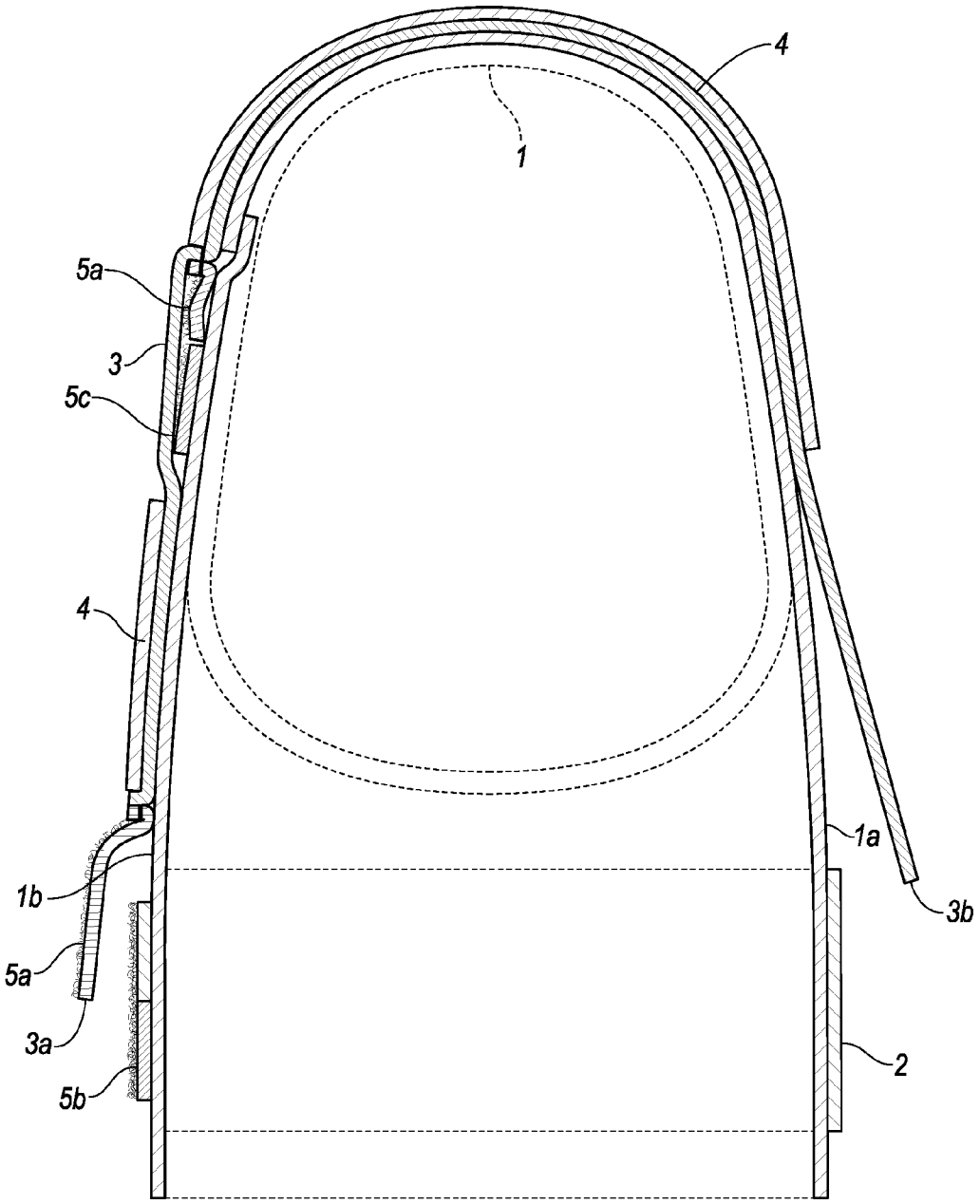
FIG. 15E is a sectional view of the vest of FIGS. 15A and 15B.

Referring to FIGS. 15D and 15E, in some implementations, the user may engage the quick release mechanism by a frontal pull of the second end 3*b* of the pull cord 3. The frontal pull causes the first end 3*a* of the pull cord 3 to vertically peel the pull tab portion 5*a* of the connector 5 from the cummerbund portion 5*b* of the connector 5 to disengage the hook and loop fastener. The frontal pull also causes the non-end attachment 3*c* of the pull cord 3 to vertically peel the pull tab portion 5*a* of the connector 5 from the affixed portion 5*c* of the connector 5.

Figure 16A:
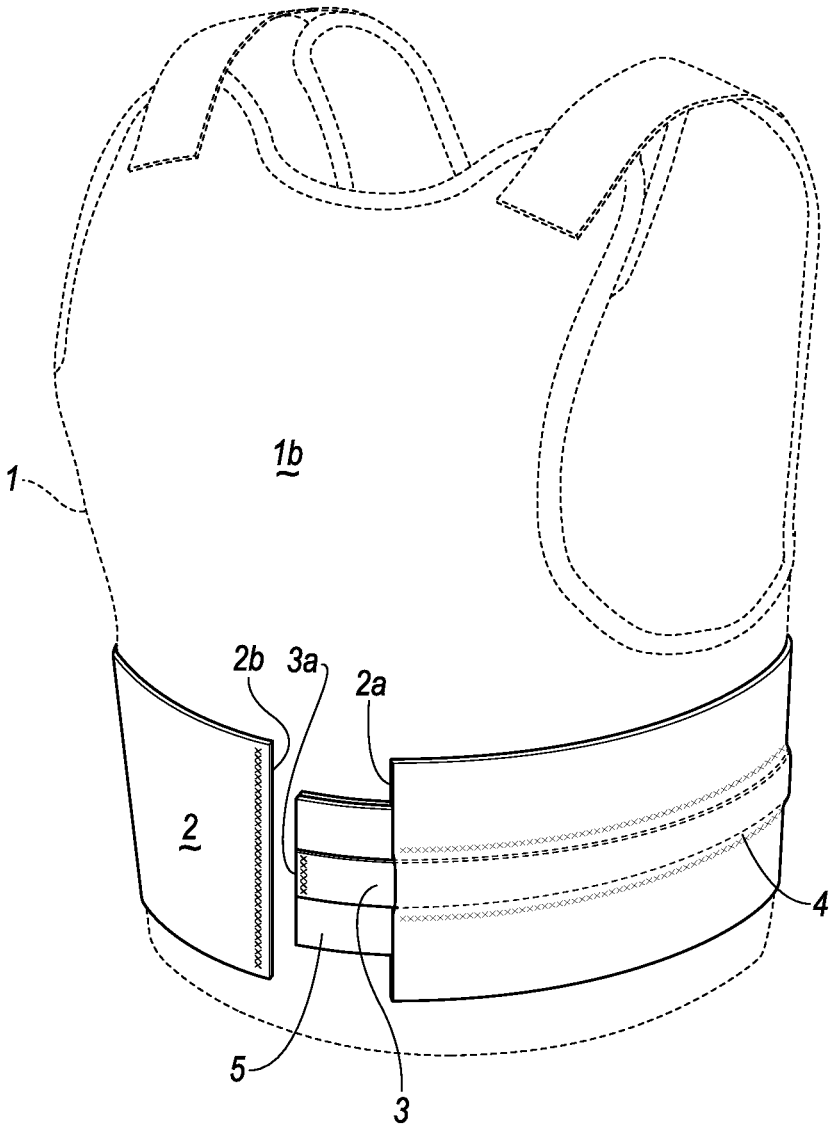
FIG. 16A is an isometric view of the back portion of a vest including a cummerbund that utilizes another exemplary implementation of the quick release fastening system. The fastening system of the cummerbund of FIG. 16A utilizes a design which allows the connector at one end of the cummerbund to fasten to the back portion of the vest.
Figure 16B:
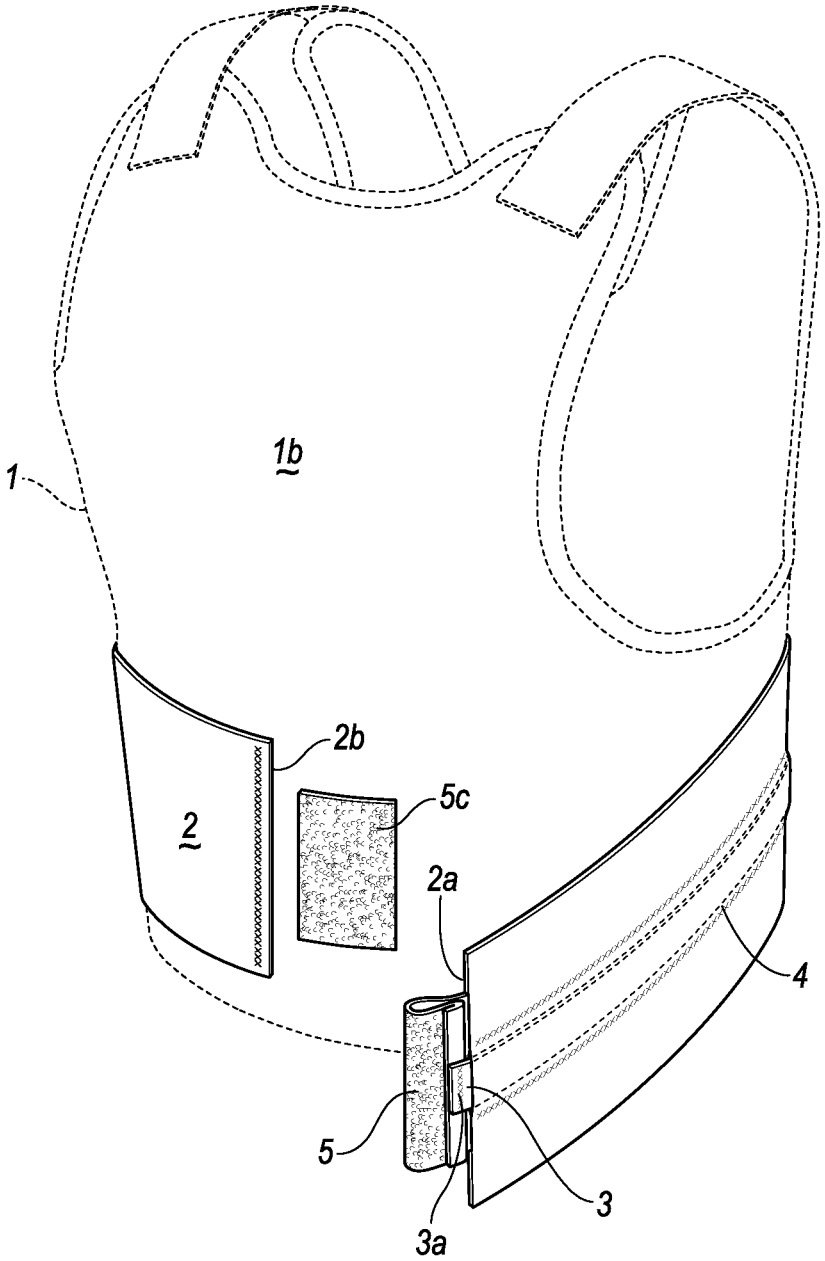
FIG. 16B is an isometric view of the back portion of the vest of FIG. 16A.

Referring to FIGS. 16A and 16B, in some implementations, the second end 2*b* of the cummerbund 2 is affixed to the back portion 1*b* of the vest 1. The first end 2*a* of the cummerbund 2 terminates into a connector 5. The first end 3*a* of the pull cord 3 is affixed to the connector 5.

Referring specifically to FIG. 16B, the user's frontal pull of the second end 3*b* of the pull cord 3 engages the quick release fastening system, resulting in the first end 3*a* of the pull cord 3 peeling the connector 5 to disengage the hook and loop fastener. The affixed portion 5*c* of the connector 5, comprising either a hook portion or a loop portion of a hook and loop fastener, is disposed on the lower back portion 1*b* of the vest 1.

After engagement of the quick release fastening system, the second end 2*b* of the cummerbund 2 remains, in the exemplary embodiment of FIG. 16B, attached to the back portion 1*b* of the vest 1. In addition to this embodiment, the present disclosure includes other similar embodiments utilizing an affixed portion 5*c* of the connector 5 at the lower back portion 1*b* of the vest 1. For example, the second end 2*b* of the cummerbund 2 could include an additional connector 5, comprising either a hook portion or a loop portion of a hook and loop connector, that fastens directly to the affixed portion 5*c* of the connector 5.

A number of implementations have been described. For example, the implementations disclosed herein have been discussed in conjunction with applications for vests, cummerbunds and the like. However, it is to be understood that in its broadest application, this invention relates to fasteners, and fastening systems irrespective of the application at hand, and, accordingly, any application wherein two articles need to be releasably fastened (such as wearable articles, hand bags, back packs, suit cases, briefcases, tool cases, shipping containers, toys, and the like) may utilize the disclosure. Nevertheless, it will be understood that various modifications may be made without departing from the spirit and scope of the disclosure. Accordingly, other implementations are within the scope of the following claims.

What is claimed is:

1. An apparatus, comprising:

an elongated strap comprising a first end, a second end, and a quick-release fastener, the quick-release fastener having a peelable portion directly connected to the first end of the substrate member, and a fixed portion directly connected to the second end of the elongated strap, wherein the peelable portion is selectively-attached to, and overlapped with, the fixed portion; and a pull cord movably-supported upon the elongated strap, wherein the pull cord includes a peelable end, and a handle end, wherein the peelable end of the pull cord is fastened to the peelable portion of the quick-release fastener, wherein the peelable end of the pull cord that includes the peelable portion fastened thereto extends across the fixed portion for permitting selective attachment of the peelable portion to the fixed portion, and selective detachment of the peelable portion from the fixed portion in response to a pulling force applied to the handle end of the pull cord, and wherein the pull cord is moveably-arranged within a conduit connected to the elongated strap, wherein the handle end of the pull cord extends outside of a first end of the conduit, wherein the peelable end of the pull cord extends outside of a second end of the conduit.

2. The apparatus of claim 1, further comprising a vest, wherein the fixed portion of the quick-release fastener is attached to the vest, wherein the vest comprises a back portion and a front portion.

3. The apparatus of claim 2, wherein the peelable portion and the fixed portion of the quick-release fastener are arranged upon the back portion of the vest, wherein the handle end of said pull cord is movably arranged upon the front portion of the vest.

4. The apparatus of claim 2, wherein said elongated strap includes: a first half having a proximal end and a distal end, and a second half having a proximal end and a distal end, wherein the proximal end of each of the first half of the elongated strap and the second half of the elongated strap are fastened to the front portion of the vest.

5. The apparatus of claim 2, wherein the quick-release fastener is defined by a hook-and-loop fastener, wherein the peelable portion is defined by one of a loop portion and a hook portion of the hook-and-loop fastener, wherein the fixed portion is defined by the other of the loop portion and the hook portion of the hook-and-loop fastener.

6. The apparatus of claim 1, wherein the peelable end of the pull cord extends laterally along the peelable portion of the quick-release fastener.

7. The apparatus of claim 1, wherein the quick-release fastener is defined by a hook-and-loop fastener, wherein the peelable portion is defined by one of a loop portion and a hook portion of the hook-and-loop fastener, wherein the fixed portion is defined by the other of the loop portion and the hook portion of the hook-and-loop fastener.

8. The apparatus of claim 1, wherein the peelable end of the pull cord is directly fastened to the peelable portion of the quick-release fastener.

9. The apparatus of claim 1, wherein the peelable end of the pull cord is a distal end of the pull cord, wherein the handle end of the pull cord is a proximal end of the pull cord that defines a user-engaging portion.

10. The apparatus of claim 1, wherein the peelable end of the pull cord is adjacently fastened to the peelable portion of the quick-release fastener.

11. A system, comprising:

a cummerbund comprising a first end, a second end, and a quick-release fastener, the quick-release fastener having a peelable portion directly connected to the first end of the cummerbund, and a fixed portion directly connected to the second end of the cummerbund, wherein the peelable portion is selectively attached to, and overlapped with, the fixed portion;

a vest having a front portion and a back portion; and a pull cord movably-supported upon the cummerbund, wherein the pull cord includes a peelable end and a handle end, wherein the peelable end of the pull cord is fastened to the peelable portion of the quick-release fastener, wherein the peelable end of the pull cord that includes the peelable portion attached thereto extends across the fixed portion for permitting selective attachment of the peelable portion to the fixed portion and selective detachment of the peelable portion from the fixed portion in response to a pulling force applied to the handle end of the pull cord, wherein the peelable end of the pull cord is arranged over the back portion of the vest, wherein the handle end of the pull cord is movably-arranged over the front portion of the vest, wherein the quick-release fastener is defined by a hook-and-loop fastener, wherein the peelable portion is defined by one of a loop portion and a hook portion of the hook-and-loop fastener, wherein the fixed portion is defined by the other of the loop portion and the hook portion of the hook-and-loop fastener.

12. The system of claim 11, wherein the pull cord partially resides in a conduit connected to the cummerbund.

13. The system of claim 11, wherein the peelable end of the pull cord is directly fastened to the peelable portion of the quick-release fastener.

14. The system of claim 11, wherein the peelable end of the pull cord is a distal end of the pull cord, wherein the handle end of the pull cord is a proximal end of the pull cord that defines a user-engaging portion.

15. The system of claim 11, wherein the peelable end of the pull cord is adjacently fastened to the peelable portion of the quick-release fastener.

16. An apparatus, comprising:

an elongated strap comprising a first end, a second end, and a quick-release fastener, the quick-release fastener having a peelable portion directly connected to a first end of the elongated strap, and a fixed portion directly connected to a second end of the elongated strap, wherein the peelable portion is selectively-attached to, and overlapped with, the fixed portion; and a pull cord movable-supported upon the elongated strap, wherein the pull cord includes a peelable end, and a handle end, wherein the peelable end of the pull cord: is fastened to the peelable portion of the quick-release fastener, and extends across the fixed portion of the quick-release fastener, and wherein the pull cord is moveably-arranged within a conduit connected to the elongated strap, wherein the handle end of the pull cord extends outside of a first end of the conduit, wherein the peelable end of the pull cord extends outside of a second end of the conduit.

17. The apparatus of claim 16, further comprising a vest, wherein the fixed portion of the quick-release fastener is attached to the vest, wherein the vest comprises a back portion and a front portion.

18. The apparatus of claim 17, wherein the peelable portion and the fixed portion of the quick-release fastener are arranged upon the back portion of the vest, wherein the handle end of said pull cord is movably arranged upon the front portion of the vest.

19. The apparatus of claim 17, wherein said elongated strap includes:

a first half having a proximal end and a distal end, and a second half having a proximal end and a distal end, wherein the proximal end of each of the first half of the elongated strap and the second half of the elongated strap are fastened to the front portion of the vest.

20. The apparatus of claim 17, wherein the quick-release fastener is defined by a hook-and-loop fastener, wherein the peelable portion is defined by one of a loop portion and a hook portion of the hook-and-loop fastener, wherein the fixed portion is defined by the other of the loop portion and the hook portion of the hook-and-loop fastener.

21. The apparatus of claim 16, wherein the peelable end of the pull cord extends laterally along the peelable portion of the quick-release fastener.

22. The apparatus of claim 16, wherein the quick-release fastener is defined by a hook-and-loop fastener, wherein the peelable portion is defined by one of a loop portion and a hook portion of the hook-and-loop fastener, wherein the fixed portion is defined by the other of the loop portion and the hook portion of the hook-and-loop fastener.

23. The apparatus of claim 16, wherein the peelable end of the pull cord is directly fastened to the peelable portion of the quick-release fastener.

24. The apparatus of claim 16, wherein the peelable end of the pull cord is adjacently fastened to the peelable portion of the quick-release fastener.

25. The apparatus of claim 16, wherein the peelable portion of the quick-release fastener and the fixed portion of the quick-release fastener are defined by a plurality of selectively-attachable states including:

(1) an attached state defined by: the peelable end of the pull cord extending across the fixed portion of the quick-release fastener, and the peelable portion of the quick-release fastener being arranged directly adjacent to the fixed portion of the quick-release fastener, (2) an intermediate attached state defined by: the peelable end of the pull cord extending partially across the fixed portion of the quick-release fastener, and the peelable portion of the quick-release fastener being arranged partially directly adjacent to the fixed portion of the quick-release fastener, and (3) a detached state defined by: the peelable end of the pull cord arranged away from the fixed portion of the quick-release fastener, and the peelable portion of the quick-release fastener being arranged in a spaced-apart orientation relative to the fixed portion of the quick-release fastener.

* * * * *